US008915268B2

(12) United States Patent
Burns et al.

(10) Patent No.: US 8,915,268 B2
(45) Date of Patent: Dec. 23, 2014

(54) SYSTEM AND METHOD FOR FILLING A PORTABLE LIQUEFIED GAS STORAGE/DELIVERY SYSTEM

(75) Inventors: Rickey Dean Burns, Alpharetta, GA (US); Tory Deane Werne, Woodstock, GA (US); Michele Rose Marut, White Plains, NY (US); Paul Denis McGroary, Giosonia, PA (US); Mark Hoeveler, Bothell, WA (US); Aashi Vel, Cambridge, MA (US)

(73) Assignee: RIC Investments, LLC, Wilmington, DE (US)

( * ) Notice: Subject to any disclaimer, the term of this patent is extended or adjusted under 35 U.S.C. 154(b) by 254 days.

(21) Appl. No.: 13/425,694

(22) Filed: Mar. 21, 2012

(65) Prior Publication Data

US 2013/0067953 A1 Mar. 21, 2013

Related U.S. Application Data

(62) Division of application No. 12/103,976, filed on Apr. 16, 2008, now Pat. No. 8,156,972.

(60) Provisional application No. 60/925,373, filed on Apr. 20, 2007.

(51) Int. Cl.

| | |
|---|---|
| ***B65B 1/04*** | (2006.01) |
| ***B65B 1/30*** | (2006.01) |
| ***B67C 3/00*** | (2006.01) |
| ***F17C 9/00*** | (2006.01) |
| ***F17C 13/08*** | (2006.01) |
| ***F25J 1/00*** | (2006.01) |
| *A62B 7/06* | (2006.01) |

(52) U.S. Cl.

CPC ... *F17C 9/00* (2013.01); *A62B 7/06* (2013.01); *F17C 13/084* (2013.01); *F17C 2205/0111* (2013.01); *F17C 2205/0126* (2013.01); *F17C 2205/0157* (2013.01); *F17C 2221/011* (2013.01); *F17C 2223/0123* (2013.01); *F17C 2223/0161* (2013.01); *F17C 2223/033* (2013.01); *F17C 2223/035* (2013.01); *F17C 2270/025* (2013.01); *F25J 1/00* (2013.01)

USPC ..... 141/2; 141/5; 141/113; 141/207; 141/319; 141/349; 222/144

(58) Field of Classification Search

CPC ..... A62B 7/00; A62B 7/06

USPC ..... 141/1, 2, 5, 113, 124, 151, 156, 207, 141/273, 319, 346–349, 356; 222/144

See application file for complete search history.

(56) References Cited

U.S. PATENT DOCUMENTS 3,749,141 A * 7/1973 Garretson ..... 141/5
4,211,086 A 7/1980 Leonard (Continued)

OTHER PUBLICATIONS

Portable Oxygen: A User's Perspective, http/www.portableoxygen.org/liquid02.html. pp. 1-13, Nov. 15, 2006.

(Continued)

*Primary Examiner* — Nicolas A Arnett

(74) *Attorney, Agent, or Firm* — Michael W. Haas

(57) ABSTRACT

A liquefied gas storage/delivery system and method that includes a liquefied gas storage system. The liquefied gas storage system includes a housing containing a storage vessel suited to contain a supply of liquefied gas, such as liquid oxygen (LOX). A rotatable turntable is provided on an exterior surface of the housing. An interface shaped to match the shape of at least a portion of a portable liquid storage/delivery device is provide in or on the turntable. A connector is disposed in the interface that couples to a corresponding connector on the portable liquid storage/delivery device. The two connectors are coupled by placing the portable liquid storage/delivery device in the interface and rotating the turntable.

6 Claims, 13 Drawing Sheets

(56) References Cited

U.S. PATENT DOCUMENTS

| | | | | |
|---|---|---|---|---|
| 4,625,753 | A | 12/1986 | Gustafson | |
| 4,640,031 | A | 2/1987 | Hoek | |
| 4,827,643 | A | 5/1989 | Hearst | |
| 4,956,975 | A | 9/1990 | Gustafson | |
| 5,183,483 | A | 2/1993 | Servido | |
| 5,354,361 | A | 10/1994 | Coffield | |
| 5,539,188 | A | 7/1996 | Fallah | |
| 5,561,983 | A | 10/1996 | Remes | |
| 5,617,739 | A | 4/1997 | Little | |
| 5,687,777 | A | 11/1997 | Dobson | |
| 5,724,832 | A | 3/1998 | Little | |
| 5,858,062 | A | 1/1999 | McCulloh | |
| 5,893,275 | A | 4/1999 | Henry | |
| 5,921,235 | A | 7/1999 | Kronekvist | |
| 5,979,440 | A | 11/1999 | Honkonen | |
| 5,988,165 | A | 11/1999 | Richey | |
| 5,997,617 | A | 12/1999 | Czabala | |
| 6,190,441 | B1 | 2/2001 | Czabala | |
| 6,212,904 | B1 | 4/2001 | Arkharov | |
| 6,314,957 | B1 * | 11/2001 | Boissin et al. | 128/204.17 |
| 6,348,082 | B1 | 2/2002 | Murdoch | |
| 6,393,802 | B1 | 5/2002 | Bowser | |
| 6,393,846 | B1 | 5/2002 | Frye | |
| 6,395,065 | B1 | 5/2002 | Murdoch | |
| 6,446,630 | B1 | 9/2002 | Todd | |
| 6,497,755 | B2 | 12/2002 | Murdoch | |
| 6,575,159 | B1 | 6/2003 | Frye | |
| 6,651,653 | B1 | 11/2003 | Honkonen | |
| 6,681,764 | B1 | 1/2004 | Honkonen | |
| 6,698,423 | B1 | 3/2004 | Honkonen | |
| 6,742,517 | B1 | 6/2004 | Frye | |
| 6,843,247 | B2 | 1/2005 | Frye | |
| 6,889,726 | B2 | 5/2005 | Richey | |
| 6,904,913 | B2 | 6/2005 | Aylsworth | |
| 6,923,180 | B2 | 8/2005 | Richey | |
| 7,121,116 | B2 * | 10/2006 | Kamoshita et al. | 62/643 |
| 7,165,422 | B2 * | 1/2007 | Little | 62/613 |
| 7,204,249 | B1 | 4/2007 | Richey | |
| 7,213,400 | B2 | 5/2007 | Dickerson | |
| 7,896,958 | B2 * | 3/2011 | Sermet et al. | 96/108 |
| 8,156,972 | B2 * | 4/2012 | Burns et al. | 141/349 |
| 2003/0234062 | A1 * | 12/2003 | Wei | 141/319 |
| 2004/0045315 | A1 * | 3/2004 | Kamoshita et al. | 62/615 |
| 2006/0048644 | A1 | 3/2006 | Doensky | |
| 2006/0086102 | A1 | 4/2006 | Dickerson | |
| 2006/0283517 | A1 | 12/2006 | McCulloh | |
| 2007/0039616 | A1 | 2/2007 | Hughes | |
| 2008/0047426 | A1 | 2/2008 | Dolensky | |
| 2008/0047435 | A1 | 2/2008 | Dolensky | |

OTHER PUBLICATIONS

Helios H300,Personal Oxygen System Filling Guide, 2003.

EasyMate Liquid Oxygen System PM2200 Series, User Manual, 2006.

* cited by examiner

SYSTEM AND METHOD FOR FILLING A PORTABLE LIQUEFIED GAS STORAGE/DELIVERY SYSTEM

CROSS-REFERENCE TO RELATED APPLICATIONS

This application is a Divisional under 35 U.S.C. §120 from U.S. patent application Ser. No. 12/103,976, filed Apr. 16, 2008, now U.S. Pat. No. 8,156,972, granted Apr. 17, 2012, which claims priority under 35 U.S.C. §119(e) from provisional U.S. patent application No. 60/925,373, filed Apr. 20, 2007, the contents of which are incorporated herein by reference.

BACKGROUND OF THE INVENTION

1. Field of the Invention

The present invention pertains to an ambulatory liquefied gas system, and, in particular, to a system and method for filling a portable liquefied gas storage/delivery unit from a liquefied gas storage system.

2. Description of the Related Art

The delivery of supplemental oxygen to a patient is typically prescribed for individuals suffering from pulmonary/respiratory problems. The prescription and delivery of supplemental oxygen is undertaken to ensure that sufficient oxygen levels are received by the patient. Situations where supplemental oxygen may be prescribed include individuals afflicted with a chronic obstructive pulmonary disease, such as asthma, as well as individuals suffering from diseased or damaged lungs.

It is known to deliver supplemental oxygen using a liquid oxygen ("LOX") system. A conventional LOX system includes a large stationary LOX storage canister that is located at and remains in the user's home. The stationary LOX canister is replenished periodically from a mobile LOX storage vessel, which is typically a truck carrying a large quantity of LOX. A conventional LOX system also includes a small, portable storage/delivery apparatus weighing from five to thirteen pounds that can be filled from the stationary unit for trips outside the home.

One such LOX system is disclosed in U.S. Pat. No. 6,742,517 ("the '517 patent") entitled, High Efficiency Liquid Oxygen Storage and Delivery System. As disclosed in this patent, a typical LOX system includes a stationary LOX storage canister located in an individual's home and a portable LOX delivery unit that the patient uses outside the home. The name of the portable delivery unit in the commercial implementation of this LOX system and described in the '517 patent is the HELiOS®. As identified at the HELiOS website, www.heliosoxygen.com, the HELiOS H300 portable LOX delivery unit has a limited capacity for storing liquid oxygen.

The HELiOS system is refilled by firmly forcing the HELiOS H300 portable LOX delivery unit onto the LOX storage canister by pressing down on the HELiOS H300 portable LOX delivery unit to cause it to engage with the LOX storage canister. While forcing the HELiOS H300 portable LOX delivery unit onto the LOX storage canister the user must manually move a vent valve level on the exterior of the portable deliver unit to an open position. This requires simultaneously applying a downward force on the HELiOS H300 portable LOX delivery unit and moving the valve level. Naturally, this requires using both hands or using more than one person to fill the portable delivery unit.

During filling, the user must maintain a watch on the HELiOS H300 portable LOX delivery unit until sputtering in the filling noise associated with the filling of the unit. In addition, the user must watch for the release of white vapor from the HELiOS H300 portable LOX delivery unit in order to ensure that the unit has been completely filled. After which, the user is instructed to release the portable LOX delivery unit from the storage canister.

In another system, such as the Stroller/Spirit sold by Caire, Inc., the portable LOX delivery unit can be attached to the LOX storage canister. This requires engaging a connector on the portable LOX delivery unit with a connector of the LOX storage canister. There is no interconnection between the portable LOX delivery unit and the LOX storage canister other than the connector-to-connector coupling. The coupling process also requires manually rotating or turning the portable LOX delivery unit relative to the LOX storage canister to engage the coupling on the portable LOX delivery unit with the coupling on the LOX storage canister. Once the couplings are engaged, the user must maintain a vigil over the portable LOX delivery unit to determine when the unit has been filled.

SUMMARY OF THE INVENTION

Accordingly, it is an object of the present invention to provide a liquefied gas storage/delivery system that overcomes the shortcomings of conventional systems. This object is achieved according to one embodiment of the present invention by providing a liquefied gas storage system for use in a liquefied gas storage/delivery system. The liquefied gas storage system includes a housing and a storage vessel disposed in the housing and adapted to contain a supply of liquefied gas, such as LOX. A turntable is provided on an exterior surface of the housing and is rotatable with respect to the housing. An interface is provide in or on the turntable. The interface has a shape generally corresponding to a shape of at least a portion of a housing of a portable liquid storage/delivery device. A first connector is disposed in the interface and in fluid communication with the storage vessel. The first connector is adapted to be coupled to a corresponding second connector on the portable liquid storage/delivery device so that the portable liquid storage/delivery device is placed in the interface and the turntable rotated, the connectors engage, thereby placing the storage vessel in the liquefied gas storage system in fluid communication with the portable liquid storage/delivery device.

It is a further object of the present invention to provide a liquefied gas storage/delivery system that includes the above-described liquefied gas storage system and a portable liquid storage/delivery device adapted to operate in conjunction with the liquefied gas storage system.

It is yet another object of the present invention to provide a method of providing ambulatory liquefied gas that does not suffer from the disadvantages associated with conventional ambulatory liquefied gas delivery techniques. This object is achieved by providing a method that includes (1) providing a housing adapted to contain a supply of liquefied gas in a storage vessel, (2) coupling a portable liquid storage/delivery device to a turntable provided on an exterior surface of the housing, (3) moving the turntable to engage a first connector disposed on the portable liquid storage/delivery device with a second connector provided on the housing, and (4) transferring liquefied gas from the storage vessel to the portable liquid storage/delivery device responsive to the first connector engaging the second connector.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and in the claims, the singular form of "a", "an", and "the" include plural referents unless the context clearly dictates otherwise.

DETAILED DESCRIPTION OF THE EXEMPLARY EMBODIMENTS

Figure 1:
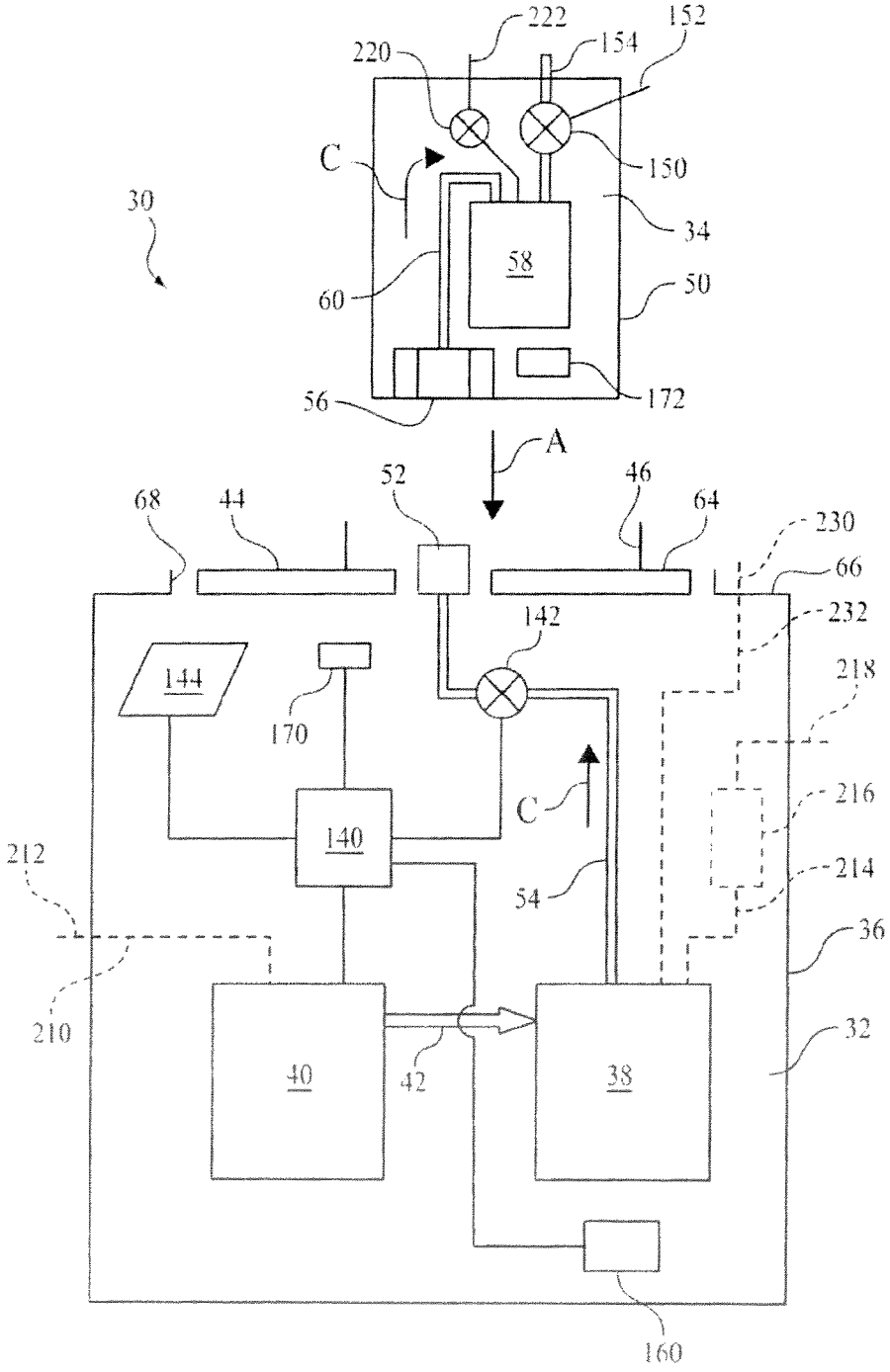
FIG. 1 is a schematic diagram of a first embodiment of a system for filling a portable liquid storage device from a liquefied gas storage system according to the principles of the present invention.

FIG. 1 schematically illustrates an exemplary embodiment of a liquefied gas storage/delivery system 30 for providing ambulatory liquefied gas for delivery to a user according to the principles of the present invention. Further details of the liquefied gas storage/delivery system and its use to provide an ambulatory supply of a liquefied gas, such as oxygen, will be discussed below with reference to FIGS. 1-9.

Liquefied gas storage/delivery system 30 includes a liquefied gas storage system 32 and a portable liquid storage/delivery device 34 adapted to be coupled to liquefied gas storage system 32. Liquefied gas storage system 32 is adapted to contain a quantity of liquefied gas, such as liquid oxygen, for delivery to the portable liquid storage/delivery device. Portable liquid storage/delivery device 34 is a relatively small, ambulatory unit that is used to carry a quantity of liquefied gas for delivery to the user. In an exemplary embodiment of the present invention, the liquefied gas is liquefied oxygen (LOX) of a grade suitable for medical purposes, and the LOX is delivered to the user via the portable liquid storage/delivery device in any conventional manner.

In the illustrated exemplary embodiment, liquefied gas storage system 32 includes a housing 36 and a storage vessel 38 disposed in the housing and adapted to contain a supply of liquefied gas, such as LOX. Storage vessel can have any configuration suitable for storing a liquefied gas. In an exemplary embodiment, the storage vessel is a double-walled vacuum insulated vessel typically used in the cryocooling art for storing very cold materials. In an exemplary embodiment of the present invention, the liquefied gas is produced by a liquefaction system 40 that is also contained in housing 36 and provided by the liquefaction system to the storage vessel 38, as indicated by arrow 42.

The present invention contemplates that liquefaction system 40 can be any system for generating a supply of liquefied gas from a gas source. Examples of suitable liquefaction systems include those described in U.S. Pat. Nos. 5,617,739; 5,724,832; 5,893,275; 6,212,904; 5,979,440; 6,651,653; 6,681,764; 6,698,423; and 7,213,400 and U.S. patent application Ser. No. 11/130,646 (publication no. 2006/0086102) (collectively referred to as "the liquefaction references"), the contents of each of which are incorporated herein by reference. In further embodiment discussed in greater detail below with respect to FIGS. 13 and 14, liquefaction system 40 includes a device for generating a supply of gas to be liquefied, such as an oxygen concentrator, and a device for liquefying the gas, typically referred to as a "liquifier."

Examples of devices for generating a supply of gas include conventional oxygen concentrators, which use a pressure swing absorption (PSA) process to produce a supply of enriched oxygen from air. U.S. Pat. Nos. 5,183,483; 5,997,617; 6,190,441; 6,348,082; 6,395,065; and 6,497,755; and U.S. patent application Ser. No. 10/935,733 (publication no. 2006/0048644), Ser. No. 11/636,235 (publication no. 2008/0047435), and Ser. No. 11/636,233 (publication no. 2008/0047426), the contents of each of which are incorporated herein by reference, disclose various oxygen concentrators and oxygen concentrations systems suitable for use in the present invention. It is to be understood that this list of pressure swing absorption systems is not intended to be limiting. In addition, other types of gas generating systems, such as ceramic and distillation processes, are contemplated for use in the present invention.

The present invention contemplates that any conventional device or system for liquefying a gas can be used in liquefaction system 40, including any conventional cryocooling system. Such systems super-cool a gas supply to a cryocooling temperature so that the gas supply converts from a gas to a liquid. Examples of cryocooling systems suitable for us in liquefaction system 40 include those disclosed in the liquefaction references as well as those disclosed in U.S. Pat. Nos. 5,617,739 and 5,724,832, the contents of each of which are incorporated herein by reference. Examples of other cryocooling systems suitable for use in the present invention include Sterling cryocoolers, Joule Thompson cryocoolers, Gifford-McMahon cryocoolers, and pulse tube cryocoolers. It is to be understood that this list of cryocooling techniques is not intended to be limiting.

The present invention contemplates that both of the elements of liquefaction system 40, i.e., (1) a system for generating a supply of gas to be liquefied, and (2) a system for liquefying the gas, can be contained in liquefied gas storage system 32. The present invention also contemplates providing only one of the elements of liquefaction system 40 in the liquefied gas storage system. For example, the system for generating a supply of gas to be liquefied (typically an oxygen concentrator) can be located outside of housing 36 as a separate device. The output of the oxygen concentrator can be coupled to an input on the housing so that the oxygen enriched gas from the oxygen concentrator is provided to the liquefaction system for liquefaction.

Liquefied gas storage system 32 includes a turntable 44 provided on an exterior surface of housing 36. Turntable 44 is rotatable with respect to the housing as discussed in greater detail below. An interface 46 is provided on the turntable to receive at least a portion of portable liquid storage/delivery device 34. More specifically, interface 46 includes an opening 48 having a shape generally corresponding to a shape of at least a portion of a housing 50 of portable liquid storage/delivery device 34 so that the portable liquid storage/delivery device sits, at least partially, within the opening of interface 46. In the illustrated exemplary embodiment, opening 48 has a general "kidney-shape" that corresponds to the kidney shape of the lower portion of housing 50. Of course, other shapes, sizes, and geometries for opening 48 are contemplated by the present invention.

Figure 2A:
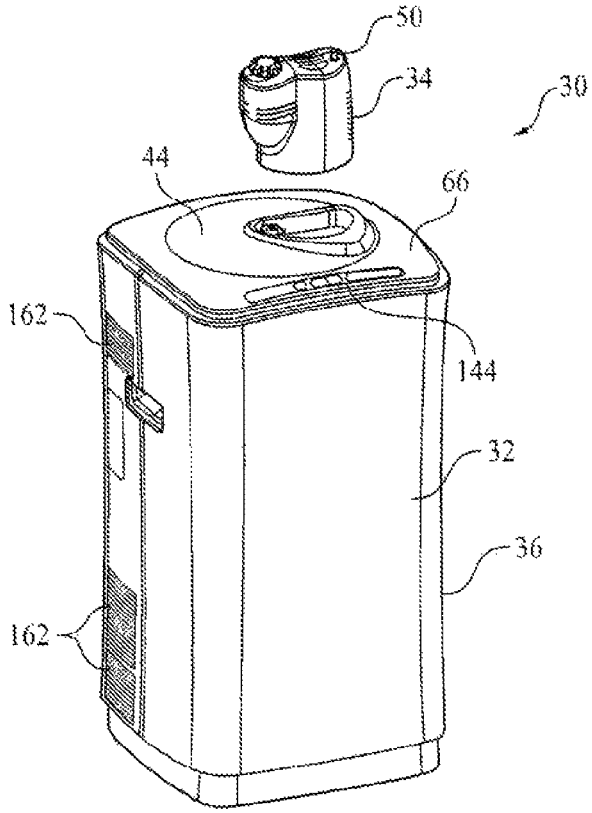
FIG. 2A-2C are perspective views showing a process for coupling the portable liquid storage/delivery device to the liquefied gas storage system.
Figure 2B:
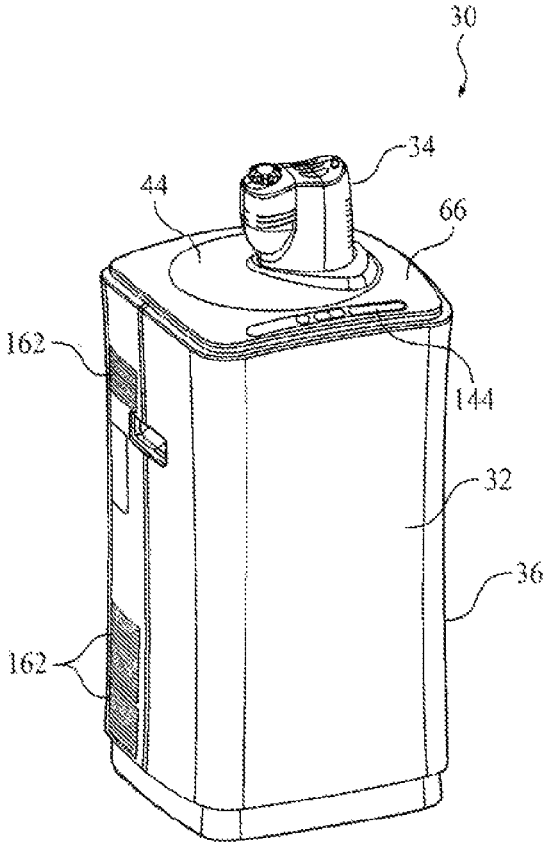
Figure 2C:
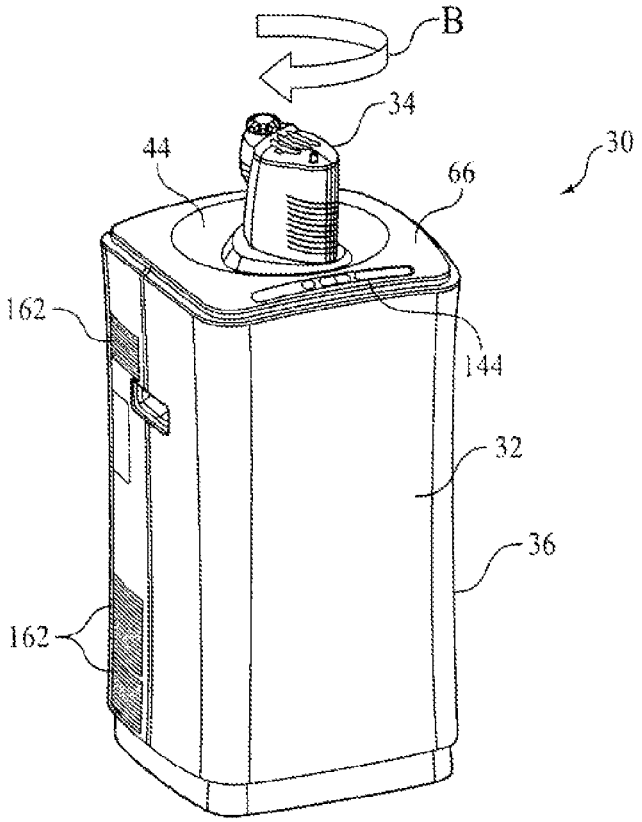

In an exemplary embodiment, interface 46 and opening 48 are sized and configured such that when the portable liquid storage/delivery device is coupled to the interface its is supported by the interface so that the user need not hold the portable liquid storage/delivery device in the interface. For example, the present invention contemplates making the walls defining opening 48 high enough to support or hold the portable liquid storage delivery device in the opening. FIGS. 2A and 2B show the placement of portable liquid storage/delivery device 34 into opening 48 of interface 46.

Figure 6:
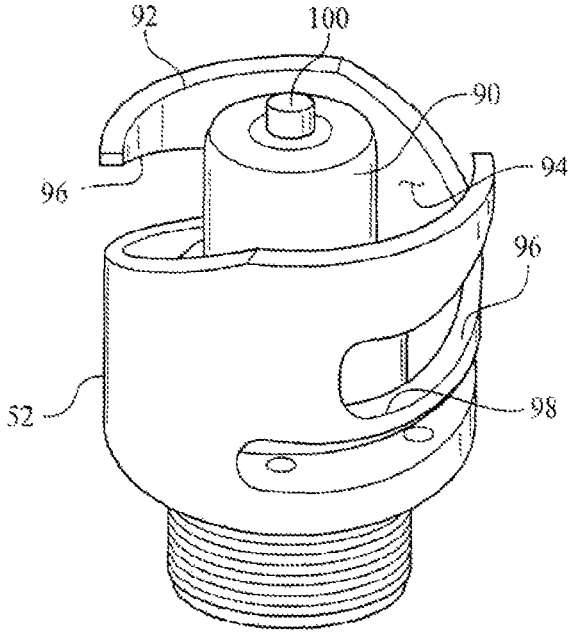
FIG. 6 is a perspective view of a first connector provided on the portable liquid storage device according to the principles of the present invention.
Figure 9:
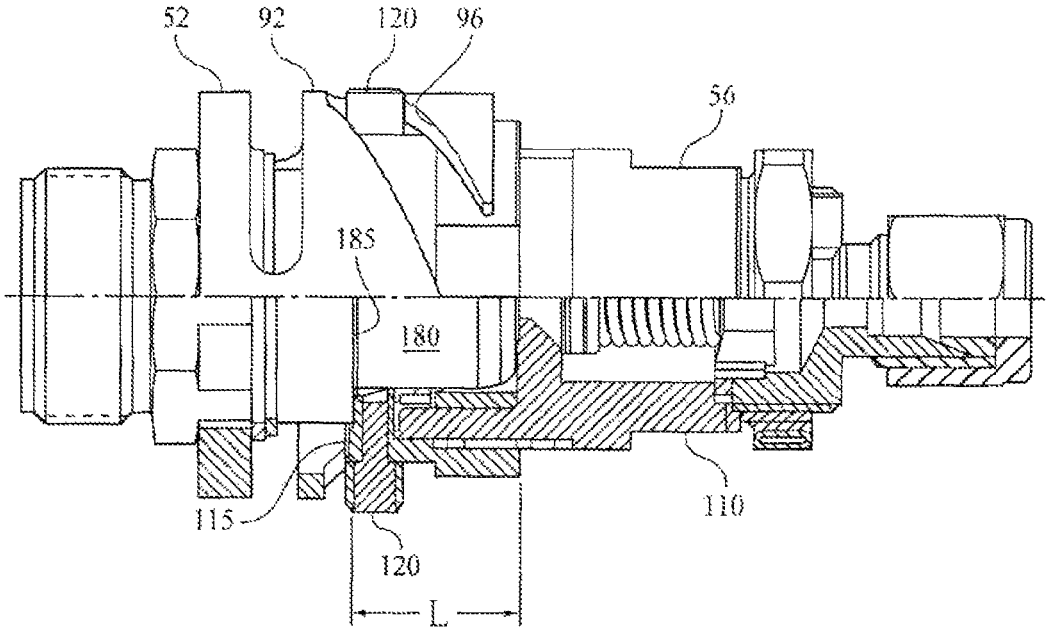
FIG. 9 is a side view, partially in section, showing the first connector engaged with the second connector.

A pneumatic connector 52, which is also referred to as a first connector, is disposed in interface 46 and in fluid communication with storage vessel 38 via a pneumatic circuit 54. Details of pneumatic connector 52 are shown in FIGS. 6 and 9 and discussed in detail below. Connector 52 is adapted to be coupled to a corresponding pneumatic connector 56, which is also referred to as a second connector, provided on portable liquid storage/delivery device 34. Coupling first connector 52 to second connector 56 is accomplished by aligning the connectors and rotating one connector relative to the other. More specifically, the second connector is rotated relative to the first connector, because first connector 52 is disposed on liquefied gas storage system 32, which remains stationary during filling.

Figure 7:
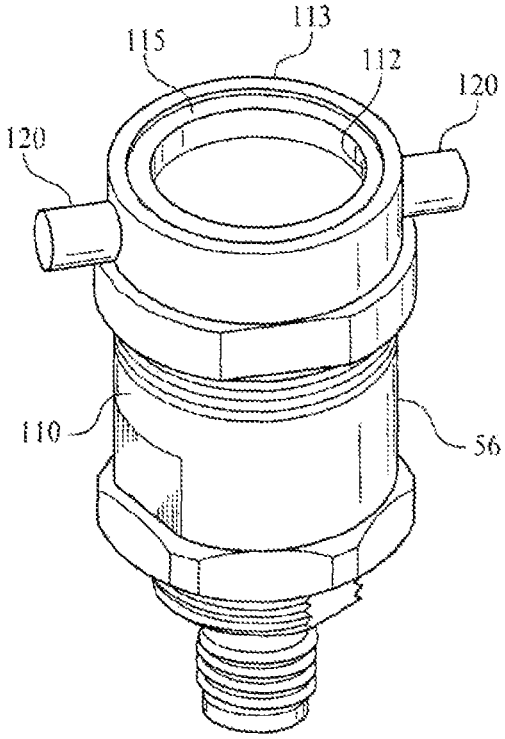
FIG. 7 is a perspective view of a second connector provided on the liquefaction system according to the principles of the present invention.
Figure 8:
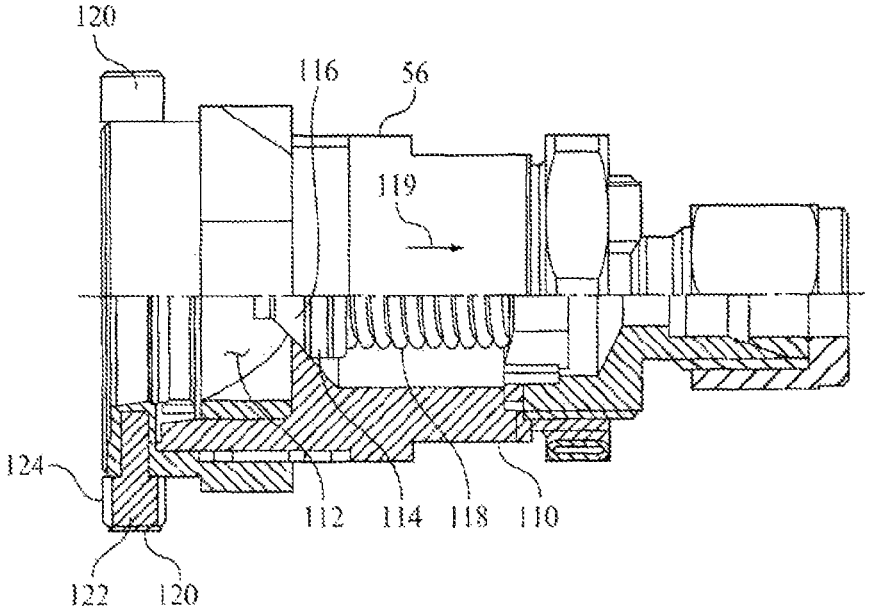
FIG. 8 is a partial cross-sectional view of the second connector of FIG. 7.

Details of pneumatic connector 56 are shown in FIGS. 7-9 and discussed in detail below. When first and second connectors 52 and 56 are engaged, storage vessel 38 is in fluid communication with the portable liquid storage/delivery device. More specifically, storage vessel 38 is in fluid communication with a storage vessel 58, which is also referred to as a dewar, provided in portable liquid storage/delivery device 34 so that liquefied gas can be transferred from storage vessel 38 to dewar 58. A pneumatic circuit 60 in the portable liquid storage/delivery device couples dewar 58 to connector 56.

The present invention also contemplates providing features associated with interface 46 or portable liquid storage/delivery device 34 to ensure that the portable liquid storage/delivery device remains coupled to the interface. In an exemplary embodiment, friction members 62 are provided in an interior wall of opening 48 to engage housing 50 of portable liquid storage/delivery device 34. Friction members 62 help ensure, for example, that the portable liquid storage/delivery device does not unexpected slip from opening 48, especially during rotation of turntable 44 and/or when connectors 52 and 56 are not positively secured to one another.

It should be noted that the present invention also contemplates that the shape of opening 48 need not generally match the shape of housing 50 of portable liquid storage/delivery device 34. To ensure that the portable liquid storage/delivery device is held to the turntable, support elements can be provided in the opening that selectively join the portable liquid storage/delivery device to the turntable. In addition, interface 46 need not include an opening defined in the turntable in order to attach the portable liquid storage/delivery device to the turntable. The present invention contemplates that interface 46 can include any support element that allows the portable liquid storage/delivery device to be selectively coupled or attached to the turntable. For example, FIG. 1 schematically shows a generally planar turntable (viewed from the side in this figure) with a pair of posts schematically illustrating interface 46. Posts, bars, rails, and arms are a few examples of structures suitable for use in interface 46 to couple the portable liquid storage/delivery device to the turntable.

It should be noted that the present invention also contemplates using features or elements to ensure that the portable liquid storage/delivery device remains coupled to the interface in addition to or in place of friction members 62 and regardless of the configuration for the interface. For example, locking tabs, hooks, snaps, claps, straps, cords, magnets, releasable fasteners (such as hook and loop fasteners), or any other type of coupling mechanism can be provided on portable liquid storage/delivery device 34 and/or liquid gas storage system 32 to ensure that these to items remain coupled in a secure fashion.

Turntable 44 is rotatable relative to housing 36 so that when the turntable moves, the portable liquid storage/delivery device that is mounted on the turntable also moves relative to the housing. In the illustrated exemplary embodiment best shown in FIGS. 3-5, turntable 44 includes a movable member 64 rotatably mounted to a base 66. In the illustrated embodiment, movable member 64 is a rigid member having a generally circular, disk, or dome shape that generally matches the surface of base 66. Base 66 also serves as a wall or side of liquefied gas storage system 32. In the illustrated embodiment, base 66 defines a top surface of the liquefied gas storage system.

Figure 10:
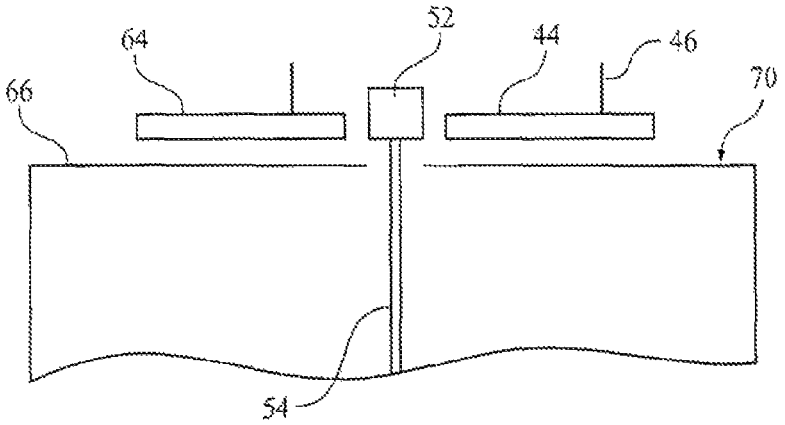
FIG. 10 is a schematic diagram of a portion of a liquefied gas storage system showing a second embodiment of the liquefied gas storage system according to the principles of the present invention.
Figure 11:
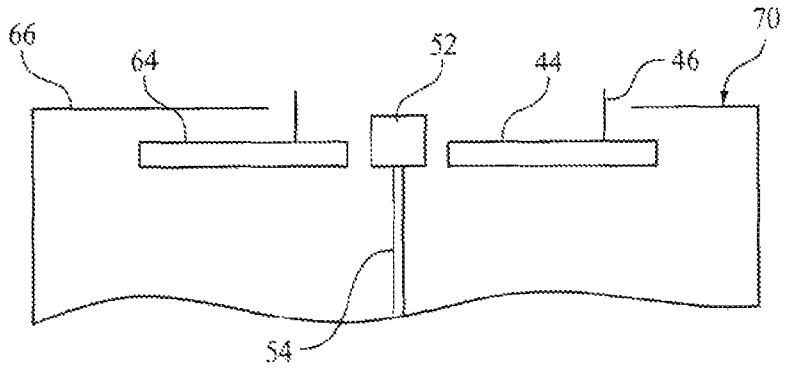
FIG. 11 is a schematic diagram of a portion of a liquefied gas storage system showing a third embodiment of the liquefied gas storage system according to the principles of the present invention.

A cavity 68 is defined in base 66 that receives movable member 64. In this configuration, the exposed surface of movable member 64 is generally flush with the exposed surface of base 66 so that the top of the liquefied gas storage system has a generally smooth or clean appearance. The present invention contemplated a wide variety of other configurations for the turntable including the moveable member. For example, as shown in FIG. 10, movable member 64 can be mounted above a top surface 70 of base 66 so that the exposed surface of the moveable members is above or spaced art from the exterior surface of the base. Conversely, as shown in FIG. 11, moveable member 64 of turntable 44 can be mounted below surface 70 of the base 66 so that the entire moveable member is below the surface of the base. A portion of the moveable member can be covered by or disposed under base 66 or the base need not cover any portion of the moveable member.

The present invention contemplates rotatably coupling movable member 64 to the remaining portions of liquefied gas storage system 32 in any one of a variety of different ways. In the illustrated exemplary embodiment, movable member 64 is snap fit into cavity 68. To this end one or more protrusions 70 are provided on a perimeter of movable member 64. A groove or channel 72 is defined around a perimeter or a portion of a perimeter of cavity 68 to receive protrusions 70. In this embodiment, the engagement between moveable member 64 and base 66 takes place at the perimeter of the moveable member. In other words, the bearing surfaces of the moveable member and the base are at the perimeter of the moveable member and the adjacent surface of the base.

Bearings 74 are provided at various locations on moveable member 64 and/or base 66 to reduce the friction between the moveable member and the base during rotation of the moveable member. In an exemplary embodiment of the present invention bearing 74 are nylon rivets having one end mounted to moveable member 64 and a convex or rounded surface at the other end that slides along a surface 76 of base 66. It can be appreciated that the present invention contemplates other bearing configurations and techniques. For example, the position of the nylon rivets can be reversed, i.e., mounted on base 66. Reduced friction surfaces can also be provided on moveable member 64 and/or base 66. Similarly, roller bearings, ball bearings, or other friction reducing mechanisms can be used as bearings 74.

Coupling the connectors is accomplished by rotating portable liquid storage/delivery device 34 disposed on turntable 44 relative to housing 36 or base 66. In an exemplary embodiment of the present invention, moveable member 64 need only rotate over a certain range of angles in order to couple first connector 52 with second connector 56. Thus, the present invention contemplates providing one or more stops 78 that limit the range of rotation for the turntable. In an exemplary embodiment, stops 78 engage protrusions 70 to limit further movement of moveable member 64 in that direction. It should be understood that other configurations and techniques for limiting the range of rotation of the turntable are also contemplated by the present invention. For example, in the embodiment of FIG. 11, base 66 can serve as a stop to control the range of motion of the turntable. The present invention also contemplates eliminating all stops, and allowing a full 360° range of movement of the turntable relative to housing 36.

Figure 3A:
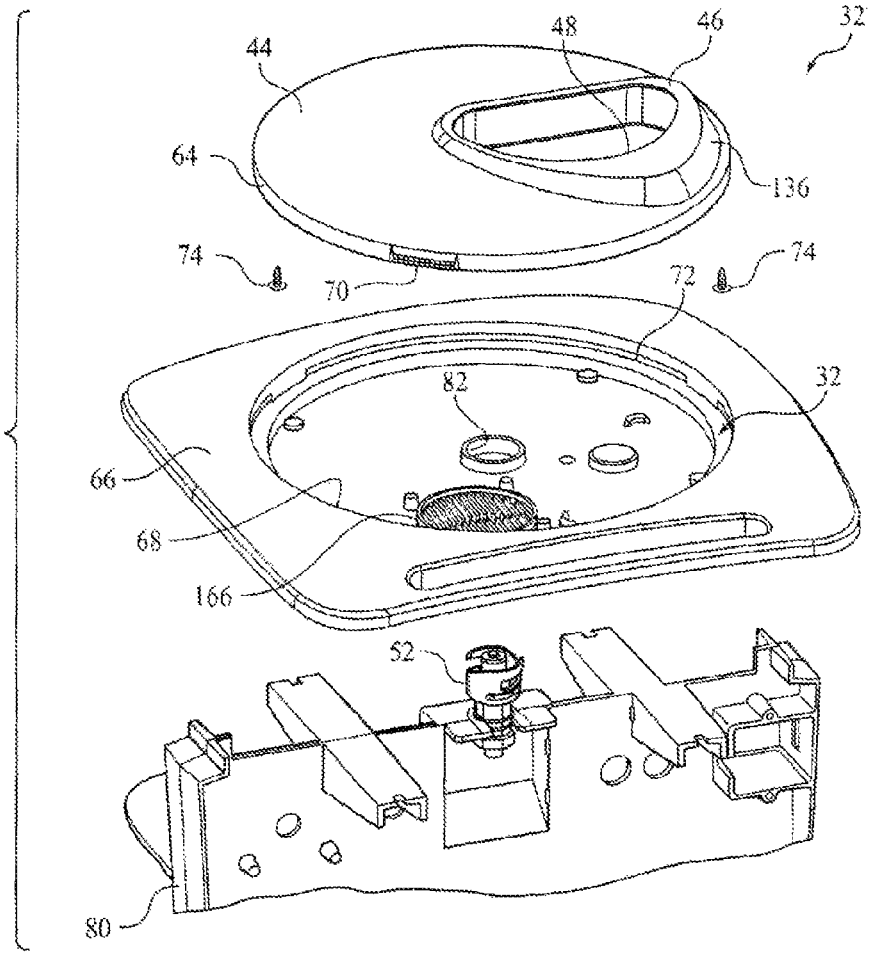
FIGS. 3A and 3B are exploded views of a portion the liquefied gas storage system of FIGS. 2A-2C.
Figure 5:
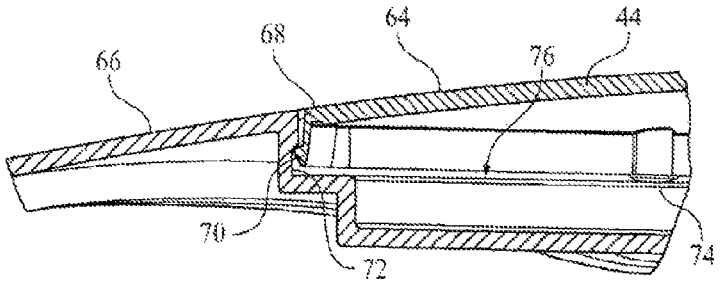
FIG. 5 is a sectional view of a portion of a liquefied gas storage system of taken along line 5-5 of FIG. 4.
Figure 3B:
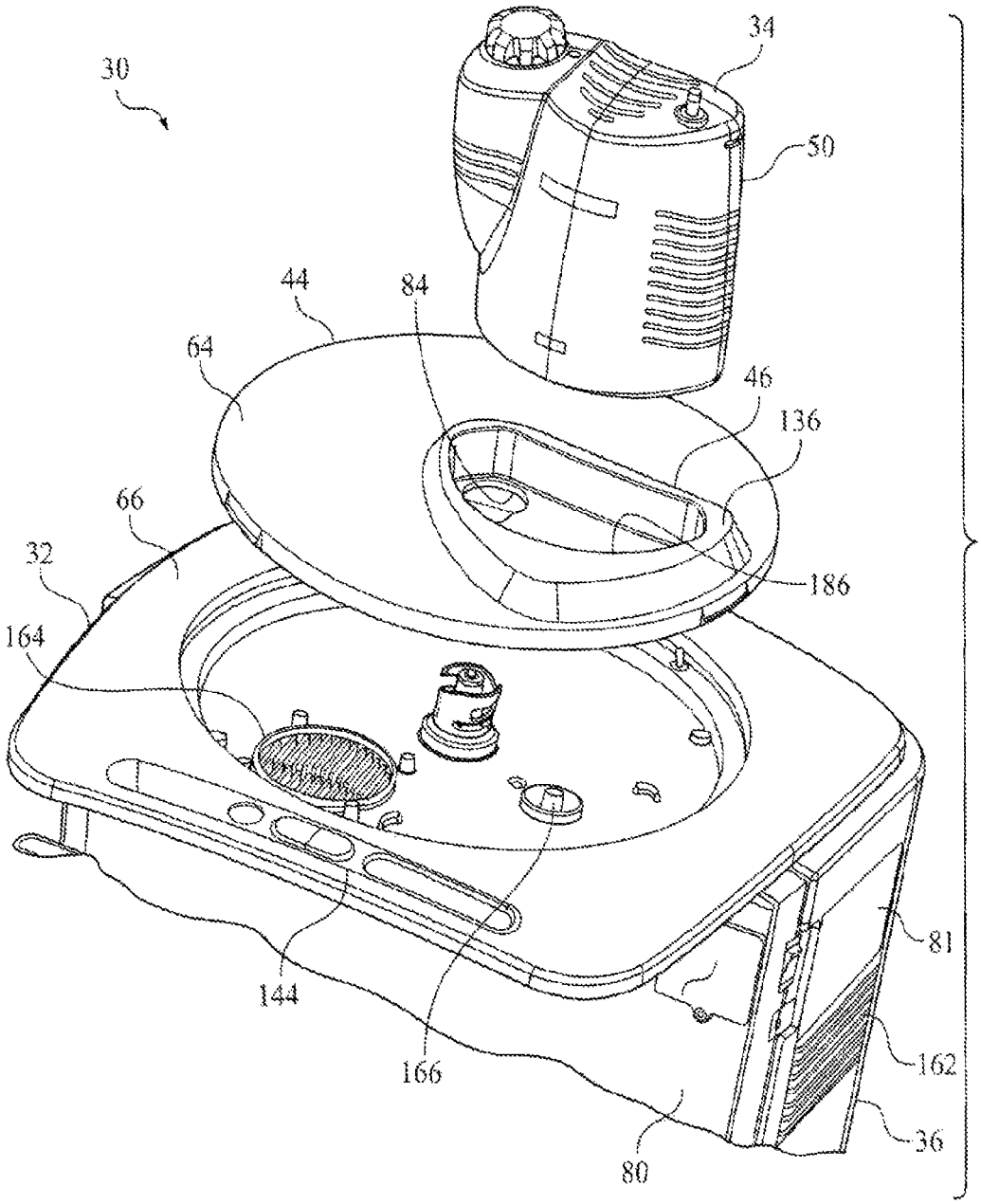

As best shown in FIGS. 3A and 3B, base 66 and first connector 52 are mounted to a frame 80. The other components of liquefied gas storage system 32 can also be mounted to frame 80, either directly or indirectly. For example, front and/or side panels 81 can be mounted to the frame. In addition, storage vessel 38 and the pneumatic circuits coupling the various components of the liquefied gas storage system can also be mounted to frame 80. Frame 80 can have any one of a variety of configurations, and should be strong enough to support the components of the liquefied gas storage system that are coupled to it. It is to be understood that the configuration for the liquefied gas storage system shown in FIGS. 3A and 3B represent only one of many ways for positioning and mounting the components of the in housing 36 and should not be considered as exclusive.

An opening 82 is provided in base 66 through which first connector 52 passes when the liquefied gas storage system is assembled. A similar opening 84 is provided in interface 46 of turntable 44. In the illustrated embodiment, opening 84 is provided in the flow of the well formed by opening 48 of interface 46. First connector 52, base 66, and moveable member 64 are sized, configured, and arranged such that a portion of the first connector remains sufficiently exposed so that it can engage second connector 56.

Referring now to FIGS. 6-9, the details of connectors 52 and 56 will be discussed. Connector 52, which is associated with liquefied gas storage system 32, includes a housing having a stem 90 and an outer basket 92 such that a space 94 is defined between the stem and the outer basket. A pair of helical or spiral slots 96 are defined in the outer basket to receive pins 120 from first coupling member 44. The slots includes a portion 98 at the end that is not helical, so that once pin 120 moves to portion 98, the pin remains within the slot. First connector 52 also includes a valve 100.

Connector 56, which is associated with portable liquid storage/delivery device 34, includes a central housing 110 having a stem receiving cavity 112 defined therein. A one way valve 114 is located in housing 100. Valve 114 includes a moveable valve member 116 biased in the closed position by a biasing force. When open, liquid gas is free to flow through housing 110. In the illustrated embodiment, this biasing force is provided by a spring 118.

A pair of pins 120 are provided on housing 100. In an exemplary embodiment, each pin 120 includes a stem 122 and an outer casing 124 rotatably mounting on the stem. This allows the outer surface, i.e., the casing, to rotate as the pin engages another surface, thereby reducing friction between the pin and the other surface.

Engaging first connector 52 with second connector 56, requires inserting stem 90 into stem receiving cavity 112, which also results in placing a wall 113 of housing 110 into space 94. Pins 120 must be aligned with the open ends of helical slots 96. The first connector and the second connector are then pushed toward one another while twisting or rotating one relative to the other so that pins 120 move along slots 96. Valve 100 engages valve 114 causing both to move to an open position. Opening of valve 114 is indicated by arrow 119 in FIG. 8. When fully inserted, an outer edge 115 of wall 113 abuts a shoulder 95 in first connector 52. The bias forces that tend to urge valves 114 and 100 in the closed position push against each other, which tends to force the first and second connectors apart. However, they are held together so long as pins 120 are located in flat portions 98 of slots 96. Thus, the user us able to cease forcing the first and second coupling members together with the coupling member remaining engaged to facilitate hands-free filling of portable liquid storage/delivery device 34.

The length of cavity 112 in second connector 56 and the length of stem 90 in first connector 52, which is indicated as length "L" in FIG. 9, are selected so that the outer edge 115 of wall 113 abuts shoulder 95 when the connectors are engaged. In an exemplary embodiment of the present invention, the overall length of first connector 52 and second connector 56 is minimized by reducing the length of cavity 112 and stem 90 below that of conventional liquid oxygen coupling members. For example, the present invention contemplates that length L is ⅝ inch or less.

The process for coupling portable liquid storage/delivery device 34 to liquefied gas storage system 32, which is done to fill the portable liquid storage/delivery device with liquefied gas, such as LOX, will be described with reference to FIGS. 1-2C and 4. In order to couple the portable liquid storage/delivery device to the liquefied gas storage system the turntable, the turntable should be in the first or "unlocked" position. In this position, interface 46 and first connector 52 are arranged configured such that when the portable liquid storage/delivery device is inserted into the well or pocket formed by opening 48 of interface 46 in turntable 44, pins 120 are aligned with the opening of helical slots 96. Because the shape of the pocket or opening 48 generally matches that of housing 50 of portable liquid storage/delivery device 34, a user is able to quickly and easily align the second connector 56 of the portable liquid storage/delivery device with the first connector 52 of liquefied gas storage system 32.

Figure 4:
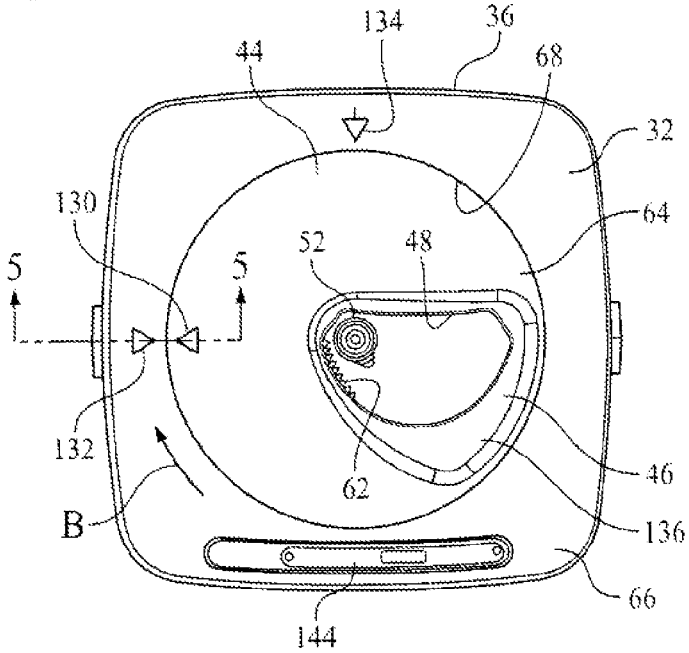
FIG. 4 is a top view of the liquefaction system of FIGS. 2A-2C.

To ensure that the turntable is in the first or "unlocked" position the present invention contemplates providing indicators on turntable 44 and base 66. As shown in FIG. 4 a position indicator 130 is provided on turntable 44 and a "first position" or "unlocked position" indicator 132 is provided on base 66. When position indicator 130 is aligned with the indicator 132, the turntable is in the "unlocked" position, indicating that portable liquid storage/delivery device 34 can be inserted into opening 48. The indicators can have an variety of configurations. For example, the present invention contemplates lighting one or both indicators 130, 132 when the two are correctly aligned. More specifically, when the indictors are not aligned, both are illuminated red. When they are aligned, one or both are illuminated green. This visual indication provides a clear and concise indication of when the turntable is in the "unlocked" position.

When turntable 44 is in the unlocked position, portable liquid storage/delivery device 34 is inserted into opening 48 of interface 46, as indicated by arrow A. As a result, connector 56 engages connector 52. Turntable is then rotated, as indicated by arrows B, to move the portable liquid storage/delivery device relative to liquefied gas storage system 32. More specifically, rotating the turntable causes portable liquid storage/delivery device 34 to pivot about an axis, where this axis corresponds to the location of connector 52. The result of rotating the turntable is that connector 56 on the portable liquid storage/delivery device is rotated into engagement with connector 52, i.e., pins 120 of connector 56 slide along helical slots 96 of connector 52.

In the illustrated exemplary embodiments, rotating turntable 44 approximately 90° is sufficient to engage connector 56 with connector 52 fully. It can be appreciated that the angle of rotation needed to complete this connection, i.e., fully lock the first and second connectors, will depend on the configuration for the connectors. In the illustrated embodiment, connector 52 has helical slots that spiral approximately 90°. Thus, 90° of rotation for the turntable are needed. When the turntable is rotated to the second or locked position, first and second connectors are coupled, as shown, for example, in FIG. 9 and fluid is capable of flowing through these connectors. In this position, pins 120 are located at areas 98 of slots 96 and the connectors will remain engaged to one another.

To allow the user to quickly visualize that the turntable has been moved to the proper position, i.e., the position in which the connectors are fully engaged and fluid transfer is possible, an second indicator 134 is provided on base 66. Alignment of indicator 130 with indicator 134 provides a visual indication that the turntable is in the second or "locked" position so that fluid transfer is possible. As before, the present invention contemplates that indicators 130 and/or 134 can be illuminated or animated in some fashion to provide a clear indication of when the turntable has been moved to the second position.

In the illustrated exemplary embodiment, rotating the turntable between the first and second (locked and unlocked) positions is done manually. For example, the user may push on the portable liquid storage/delivery device itself, while it is docked to the liquefied gas storage system via interface 46. The user may also manually spin turntable 44, for example, by pushing on a protruding portion 136 of the turntable. In the illustrated embodiment, protruding portion 136 also serves to define the wall of the pocked or well in which the portable liquid storage/delivery device is seated. Of course, the present invention also contemplates providing other griping elements, such as handles, friction pads, or knobs on the turntable to facilitate its manual movement. Providing a handle on the turntable can be done such that the handle acts as a level arm, reducing the overall forces needed to rotate the turntable.

Due to the design of the first and second connectors, namely the inclusion of a flat portion 98 of helical slot 96, the first and second connectors remain engaged when they are in the second or locked position. The present invention also contemplates that the turntable can be configured to maintain it in the second or locked position, regardless of the design of the first and/or second connectors. For example, a locking mechanism can be provided on the turntable that engages once the turntable has been rotated the necessary amount to coupling the connectors together. A latch or sliding bolt are examples of such a locking mechanism. Moreover, this locking mechanism can be manually actuated or automatically actuated. For example, an electronic lock can be automatically closed when the turntable is moved to the second position. The electronic lock can also be closed by the user, for example by activating a user interface device, such as switch, when the turntable is moved to the second position.

The lock can be manually or automatically opened upon completion of the filling process. For example, the present invention contemplates monitoring the filling process and unlocking the turntable when filling is complete. Monitoring the filling process to determine when filling is complete can be accomplished, for example, by monitoring the amount of liquid transferred to the portable liquid storage/delivery device. This can be accomplished using any conventional monitoring technique, such as monitoring the rate of flow to determine the volume transferred to the portable liquid storage/delivery device or monitoring the weight of the portable liquid storage/delivery device. To accomplish the latter technique, a scale can be included in the turntable so that the liquefied gas storage system can keep track of the weight of the portable liquid storage/delivery device relative that is couple to it.

Once the turntable is in the second position, liquefied gas is transferred from the storage vessel to the portable liquid storage/delivery device. The flow of fluid can be initiated automatically or manually using either the portable liquid storage/delivery device or the liquefied gas storage system. For example, in one embodiment of the present invention, a controller/processor 140 is provided in liquefied gas storage system 32 along with a valve 142 that operates under the control of the processor. Controller/processor 140 can be any suitable device, and includes any necessary storage capability for storing any algorithms implemented by the processor.

In an exemplary embodiment, an input/output device 144 is also provided to enable a user to communicate with the processor. For example, to cause controller 140 to open or close valve 142. The present invention contemplates that input/output device 144 is used to communicate, information, data and/or instructions and any other communicatable items, collectively referred to as "data", between a user and controller 140. This can be done locally or remotely.

Examples of common input/output interfaces suitable for local communication with the controller include a keypad and display, touch screen, buttons, switches, etc. Other communication techniques, either hard-wired or wireless, are also contemplated by the present invention. For example, the present invention contemplates providing a smart card terminal that enables data to be loaded into controller 140 from the smart card or loaded onto the smart card from the controller. Other exemplary, interface devices and techniques adapted for use with the pressure support system include, but are not limited to, an RS-232 port, CD reader/writer, DVD reader/writer, RF link, and modem (telephone, cable or other). In short, any conventional technique for providing, receiving, or exchanging data with controller 140 are contemplated by the present invention as input/output device 144.

In an exemplary embodiment, the users activates input/output device 144 to cause valve 142 to open so that the liquefied gas can flow to portable liquid storage/delivery device 34. Of course, the processor can determine, based on sensors or the like, whether the system is properly configured to dispense the liquefied gas to the portable liquid storage/delivery device. For example, the system can detect the position of the turntable, the weight of portable liquid storage/delivery device 34 and/or its contents, the amount of fluid in storage vessel 38 (which can be monitored using any conventional technique, such as floats, level detection, etc.), the temperature of the system, or any other characteristic of the system that may be of importance when determining whether to dispense fluid to the portable liquid storage/delivery device.

In another embodiment of the present invention, the once the portable liquid storage/delivery device is placed in fluid communication with storage vessel 38, i.e., by moving turntable 44 to the second or locked position, the portable liquid storage/delivery device is used to initiate the flow of gas. An example of a portable liquid storage/delivery device having this capability is disposed in U.S. provisional application No. 60/898,307, the contents of which are incorporated herein by reference. In this embodiment, portable liquid storage/delivery device 34 includes a manually actuated filling process. As shown schematically in FIG. 1, this process includes opening a vent valve 150 that couples storage vessel 58 to ambient atmosphere. Opening vent valve 150 is accomplished using a vent handle 152 that is manually is actuated by virtue of being exposed on the exterior of housing 50. In the open position, a vent line 154 communicates storage vessel 58 to the ambient atmosphere, and a closed position that substantially prevents communication of storage vessel 58 to the ambient atmosphere.

When the turntable is moved to the second position, connectors 52 and 56 are engage such that the valves in each are opened enabling fluid to flow through these connectors. Of course, fluid will not flow from storage vessel 38 into storage vessel 58 unless the pressure in the storage vessel 58 is less than that of storage vessel 38. In an exemplary embodiment of the present invention, the fluid storage system in liquefied gas storage system 32, including storage vessel 38, is maintained or can be selectively pressurized to a pressure greater than ambient atmospheric pressure. Details of how storage vessel 38 and/or other portions of the fluid storage system in liquefied gas storage system 32 are pressurized are discussed below.

To cause a pressure difference between storage vessel 58 and storage vessel 38, a user moves vent handle 152 to the open position thereby opening vent valve 150. This causes storage vessel to communicate with the ambient atmosphere, so that it assumes the atmospheric pressure. Because the atmospheric pressure is now lower than the pressure at which storage vessel 38 is maintained, fluid, such as LOX, will flow from storage vessel 38 into storage vessel 58 via pneumatic circuit 54 connectors 52 and 56, and pneumatic circuit 60. See arrows C in FIG. 1. When filling is complete or otherwise terminated, the user moves vent handle 152 to the closed position.

After the filling is complete or otherwise ended, turntable 44 is moved to the first "unlocked" position to disengage first and second connectors 52 and 56 from one another. Moving the turntable to the first position can be done manually or automatically, and can be done when the system determines that a sufficient supply of liquefied gas has been delivered to portable liquid storage/delivery device 34. Once the turntable is in the first "unlocked" position, portable liquid storage/delivery device 34 can be lifted out of interface 46 and used to deliver a flow of gas, such as oxygen, to the user as known in the art.

Liquefied gas storage system 32 includes a pressure intensifier 160 disposed in housing 36. The pressure intensifier is used to increase the pressure within storage vessel 38 so that fluid in the storage vessel can be transferred to portable liquid storage/delivery device 34 during the filling process. In an exemplary embodiment of the present invention, pressure intensifier 160 can be operated as needed, i.e., to increase the pressure in storage vessel 38 only when the filling process is initiated. In another embodiment, pressure intensifier 160 can be operated to maintain the pressure in storage vessel 38 as a certain threshold level. That is, the pressure in storage vessel 38 is monitored and used in a feedback fashion to actuate the pressure intensifier so that the pressure is at or above the threshold level.

In one embodiment of the present invention, pressure intensifier 160 includes a compressor operatively coupled to storage vessel 38 so as to increase the pressure within this container. Compressor is any suitable device that delivers a flow of pressurized gas to the storage vessel or to a pneumatic circuit, such as a circuit 54, coupled to the storage vessel. In an exemplary embodiment, the pressured gas delivered by the compressor is the same or similar gas as that stored in the storage vessel. For example, a portion of the oxygen generated by the oxygen concentrators in liquefaction system 40 can be provided to the compressor, where it is delivered at an elevated pressure to the interior of storage vessel 38.

In another embodiment, pressure intensifier 160 includes a heater adapted to increase a temperature of the liquefied gas contained in the storage vessel. The heater can be used alone, or in combination with the compressor discussed above. Heating the cryocooled, liquefied gas causes it to boil-off. Because the volume of storage vessel 38 and the pneumatic circuit coupled to it remain the same, the boiling off of the liquefied gas causes the pressure in the storage vessel to rise. Of course, the present invention contemplates providing pressure a relief valve associated with storage vessel 38 so that excess pressure is relieved.

It can be appreciated that the above-described system provides a rotational engagement mechanism that includes a pocket provided in a generally round, substantially horizontally mounted turntable. The pocket's shape is generally the same as the portion of the portable liquid storage/delivery device that fits into the pocket. That is, the pocket has a shape that is generally the same, but slightly bigger than the portion of the housing of the portable liquid storage/delivery device that is received in this pocket. The depth of the pocket and/or the height of the wall is sufficient to prevent the portable liquid storage/delivery device from easily being dislodged. A connector is provided in the pocket generally at the center of the turntable within a corner or side of the pocket. It should be noted that the shape of interface 46, e.g., generally kidney-shaped or curved on one side and flat on the other, generally matching that of portable liquid storage/delivery device 34, allows only the portable liquid storage/delivery device having this specific shape to be placed in or coupled to interface 46 so that other portable liquid storage/delivery device cannot be connected to interface 46.

In addition, the shape of the pocket helps facilitate correctly placing the portable liquid storage/delivery device in the pocket of the interface. That is, the shape of the interface ensures that the portable liquid storage/delivery device can only be placed in the pocket one way. The pocket self-aligns the portable liquid storage/delivery device by both the shape and depth of the pocket. The sidewalls of opening/pocket 48 of interface 46 serve to straighten the portable liquid storage/delivery device as it is inserted into the pocket, which also aids in aligning connectors 52 and 56. The shape of the pocket also provides a clear visual indication to the user how the orient to the portable liquid storage/delivery device so that it can be inserted into the interface.

As noted above, in one exemplary (but not limiting) embodiment, turntable 44 has a generally round and dome shaped. This shape provides a visual cut to the user of the process for coupling the portable liquid storage/delivery device to liquefied gas storage system 32. Moreover, visual indicators, such as arrows, can be provided on or near the turntable to direct the user how to rotate the turntable to engage the portable liquid storage/delivery device to the liquefied gas storage system and when the turntable has been properly rotated so that the portable liquid storage/delivery device is properly coupled to the liquefied gas storage system. The dome shape of turntable 44 also discourages users from placing items on the top of the liquefied gas storage system, allows liquids to roll off the top of the liquefied gas storage system, and reduces the overall perception that the liquefied gas storage system.

The operation of liquefied gas storage system 32 can result in the generation of heat. For example, the compressor used to generate enriched oxygen gas and/or the components used to cryo-cool the gas stream can generate heat within housing 36. The present invention contemplates venting the warm air from within housing 36 to ambient atmosphere. More specifically, the present invention contemplates providing a fan (not shown) that draws the warm air out of housing 36. In one exemplary embodiment, the fan is provided proximate to base 66 and is oriented so as to pull cool air in to housing 36 through louvers 162 in the front and/or side panels and expel the warm air from the housing through a fan vent 164 provided in base 66 under turntable 44. See FIGS. 3A and 3B. The warm air from housing 36 passed between base 66 and turntable 44 and exits the chamber defined between the base and the turntable at a perimeter of the turntable and around connector 52.

In addition to cooling the components of liquefied gas storage system 32, the warm air venting system as described above, provides a warm air flow across connector 52 and/or connector 56. This warm air, keeps the connectors from frosting or icing up during and/or between fills. During a filling process, the extremely cold liquid oxygen passing through the couplings 52 and 56 and into portable liquid storage/delivery device 34 may cause the temperature of the connectors to drop below the dew point of the surrounding air. When this happens, frost forms on the coupling. In an extreme case, ice could form. The warm air that is being circulated by the fan under turntable 44 keeps frost from accumulating on or near the connectors, and, furthermore, provides eliminates the frost and dries the connector or connectors after the fill.

During the liquid oxygen generation process, a large percentage of the oxygen enriched gas is liquefied, although not all of it. In one embodiment of the present invention, the excess oxygen-enriched gas is allowed to exit storage vessel 38, which is kept at a constant pressure, through an oxygen manifold and eventually through a phase separator 166 located in base 66 under turntable 44. The warm air venting system, as describe above, allows the warm air being pushed out of housing 36 to mix with the oxygen enriched-gas existing separator 166. This mixing of the air from housing 36 and the oxygen-enriched gas, dilutes the oxygen ratio of the gas providing an additional safety benefit.

The present invention contemplates that there may be reasons why liquefied gas storage system 32 interfaces, i.e., fills, a certain portable liquid storage/delivery device. For example, it is known when an oxygen concentrator is used to generate oxygen-enriched gas, the gas produced typically has a purity of 90-96% oxygen. The FDA requires portable liquid storage/delivery device having this purity range be labeled so as not be confused with portable liquid storage/delivery device that store liquid oxygen having a higher purity, e.g., 99% oxygen. Thus, it may be desirable to ensure that portable liquid storage/delivery devices labeled for purity ranges of 90-96% oxygen are allowed to be coupled to the liquid storage/delivery device, while portable liquid storage/delivery devices labeled for purity ranges of 99% oxygen and up are not permitted to be coupled and/or filled by liquefied gas storage system 32.

This requirement is satisfied, at least in part, by providing the uniquely shaped interface 46 for liquefied gas storage system. That is, portable liquid storage/delivery devices labeled for purity ranges of 90-96% oxygen can be configured to fit into the pocket of interface 46, while portable liquid storage/delivery devices labeled for purity ranges of 99% oxygen can have shapes that they will not allow them to fit into opening 48 of interface 46.

In another embodiment of the present invention, a communication system is provided that allows liquefied gas storage system 32 to recognized and/or communicate with portable liquid storage/delivery device 34. Using this system, liquefied gas storage system 32 can determine, for example, whether a portable liquid storage/delivery device is a device that is approved for or can otherwise be properly filled by the liquefied gas storage system. The controller can then determine whether to enable fluid to be transferred to the portable liquid storage/delivery device. For example, the data provided to the controller can include identification information indicating the type, size, brand-name, company name, or any other information about the portable liquid storage/delivery device. The controller can then whether that particular portable liquid storage/delivery device can be filled by the liquefied gas storage system. For example, the liquefied gas storage system may prevent filling of a portable liquid storage/delivery device that is not approved for receiving the liquefied gas.

In addition or in place of the identification information, the RFID information may include information about the size, condition, or usage, of the portable liquid storage/delivery device the liquefied gas storage system. The liquefied gas storage system can use this information to determine how much fluid to transfer to the portable liquid storage/delivery device. The liquefied gas storage system may also prevent the filling of a portable liquid storage/delivery device in which the condition information indicates, for example, that the portable device has suffered a malfunction. Of course, the portable liquid storage/delivery device would need to contain the necessary monitoring, processing, and storing capability for determining whether the unit has suffered a malfunction. The liquefied gas storage system may also prevent the filling of a portable liquid storage/delivery device in which the usage information indicates that the portable liquid storage/delivery device has been used for a period of time or a number of fills that exceeds a predetermined limit. Of course, the portable liquid storage/delivery device would need to contain the necessary monitoring, processing, and storing capability for determining the device usage and/or number of fills received. The present invention contemplates that any information, such as the condition or usage, can be output to the user by the liquefied gas storage system via user interface 144.

In an exemplary embodiment of the present invention, liquefied gas storage system 32 includes a communication element 170 disposed in housing 36 and in communication with controller 140. In addition, an information device 172 is provided in or otherwise associated with portable liquid storage/delivery device 34. Communication element 170 is adapted to read information associated with the portable liquid storage/delivery device when the portable liquid storage/delivery device is placed near liquefied gas storage system 32 or disposed in interface 46.

The present invention contemplates that communication element 170 and information device 172 are any suitable components of a data communication system that enables information about the portable liquid storage/delivery device to be transmitted to the liquefied gas storage system. In a further embodiment, the data communication system enables information to be transmitted by the liquefied gas storage system to the portable liquid storage/delivery device in place of or in addition to data being provided by the portable liquid storage/delivery device to the liquefied gas storage system. For example, valves provided in the portable liquid storage/delivery device can be operated under the control of controller 140 in liquefied gas storage system 32.

The following are brief discussions of examples of suitable communication systems or technologies that are capable of providing the data transmission function of communication element 170 and identification device 172. It is to be understood that the following list of suitable communication systems or techniques is not intended to be exhaustive or exclusive, but is provided to indicate the wide variety of communication systems or techniques that can be used in the system of the present invention. Indeed, the type of communication system used may depend on a variety of factors, such as the type and amount of data to be exchanged/transmitted, the durability of the components, the operating features of the components (such as whether battery power is to be used, or whether electro-magnetic, magnetic, radio, infrared (IR) or other type of radiation is desired or permitted).

a) Electro-Magnetic Devices.

Wireless communication systems that communicate wirelessly using energy can be used for the communication system. Such systems typically include an antenna or other data transmission device and a receiver. The transmission of information takes place via electro-magnetic, radio frequency (RF), d infrared (IR), or any other energy transmission technique. In this embodiment, for example, the data transmission device can be provided in the portable liquid storage/delivery device, with the corresponding data transceiver being provided in the liquefied gas storage system 32. For example, an RFID element in the portable liquid storage/delivery device and an RFID reader in the liquefied gas storage system.

b) Optical Based Systems.

Communication systems that provide an optical communication between the portable liquid storage/delivery device and the liquefied gas storage system can be used. For example, a bar code or other type of optical pattern can be provided on the portable liquid storage/delivery device and a bar code reader or other optical pattern recognition device provided on the liquefied gas storage system.

c) Acoustic and Ultrasonic Systems.

The present invention contemplates using a system that provides an acoustic or ultrasonic data transmission as the communication system.

d) Mechanical Interfaces.

The communication of information between the portable liquid storage/delivery device and the liquefied gas storage system can take place via an interaction of mechanical components. Switches, detents, pins or other mechanical elements can be provided on either the portable liquid storage/delivery device, the liquefied gas storage system, or both. For example, depending on which switches on the liquefied gas storage system are actuated as a result of the portable liquid storage/delivery device being coupled to the liquefied gas storage system, the liquefied gas storage system can know what type of portable liquid storage/delivery device is coupled to it. Of course, the portable liquid storage/delivery device is configured so that it actuates the set of switches on the liquefied gas storage system that let the liquefied gas storage system know information about that portable liquid storage/delivery device.

e) Electrical Connections/Interfaces.

The present invention also contemplates providing electrical contacts on the portable liquid storage/delivery device, the liquefied gas storage system, or both. These contacts can be used to communicate information between the portable liquid storage/delivery device and the liquefied gas storage system, i.e., as hard-wired data terminal. They can also be used to enable the portable liquid storage/delivery device to be recognized by the liquefied gas storage system. For example, a certain portable liquid storage/delivery device may have a know pattern for the connection terminals. If this pattern is not recognized by the liquefied gas storage system, it will know that an improper portable liquid storage/delivery device has been coupled to it. The electrical terminals on the portable liquid storage/delivery device can also be used by the liquefied gas storage system, for example, to make a resistance or other electrical measurement. Based on the result of this measurement, the liquefied gas storage system can determine information about the portable liquid storage/delivery device coupled to it.

f) Magnetic Couplings.

The communication system between the portable liquid storage/delivery device and the liquefied gas storage system can also be done via magnets. For example, one or more magnets can be provided in the portable liquid storage/delivery device, the liquefied gas storage system, or both. Devices for detecting the magnets or for being actuated by the magnets, such as a reed switch, can be provided in the associated portable liquid storage/delivery device, the liquefied gas storage system, or both.

Figure 12:
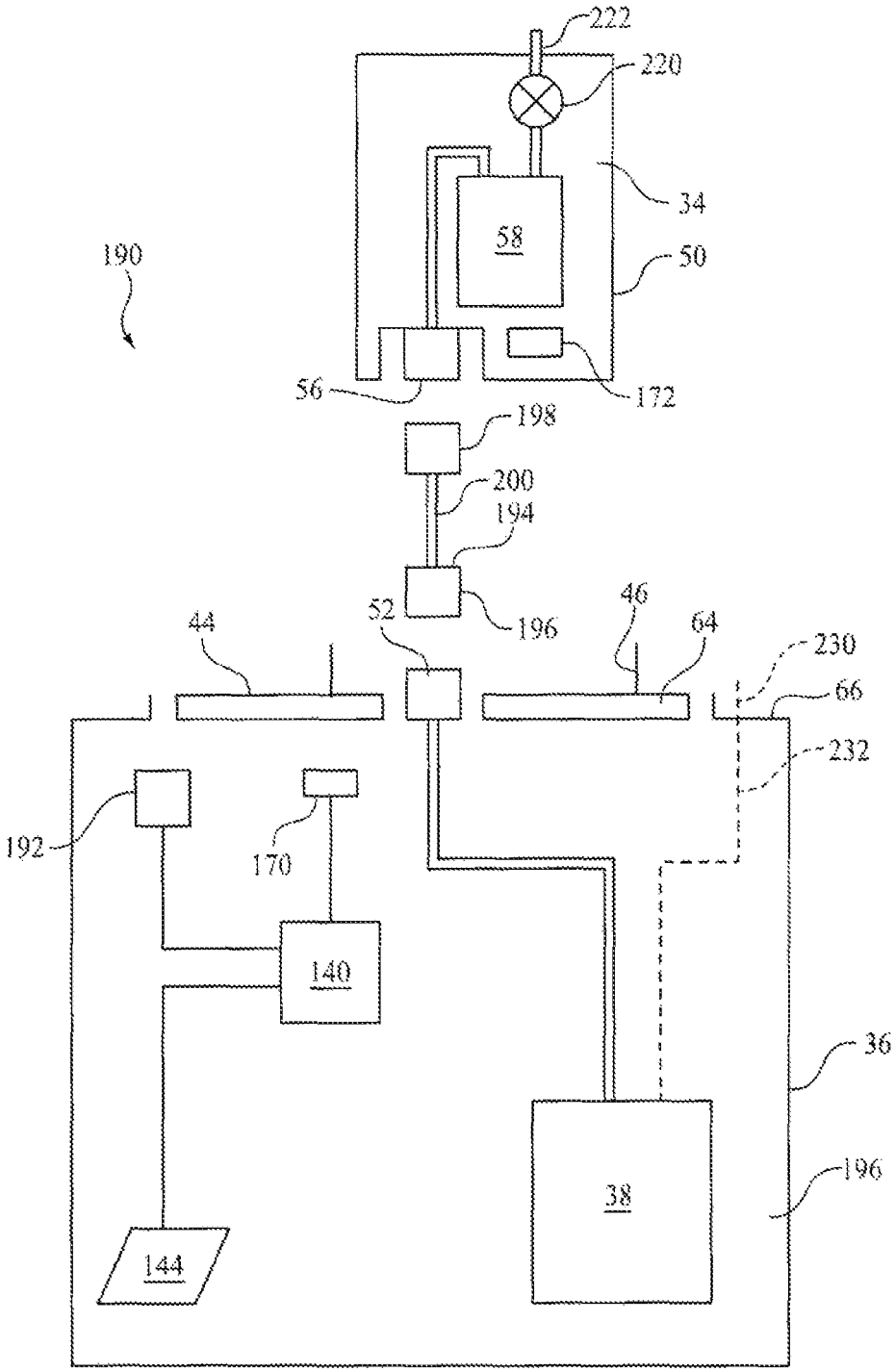
FIG. 12 is a schematic diagram of a portion of an alternative embodiment of a system for filling a portable liquid storage device from a liquefied gas storage system according to the principles of the present invention.

FIG. 12 illustrates an second embodiment for a liquefied gas storage/delivery system 190 that embodies the basis principles of the present invention. This embodiment is provided to illustrate various alternative configurations for some of the components of the liquefied gas storage/delivery system In the previous embodiments, turntable 44 is described as being rotated manually. It is to be understood that the present invention contemplates moving the turntable via a motor 192. In an exemplary embodiment, motor 192 operates under the control of controller 140. As noted above, the actuation of the motor can be done based on an input from the user and/or based on an input from a monitored parameter or sensor. For example, a switch may be provided in the interface of the turntable that is actuated when the portable liquid storage/delivery device is placed in the pocket of the turntable. Actuating the switch causes motor 192 to move the turntable to the locked position. Sensors, such as flow or weight sensors, can monitor the filling process, so that the motor is actuated to move the turntable to the unlocked position when the filling process is complete. Thus, little or no action is required by user during the filling process.

FIG. 12 also illustrates an alternative of the present invention in which an adapter 194 is used to as a bridge between connector 52 on liquefied gas storage system adapted 196 and connector 56 on portable liquid storage/delivery device 34. More specifically, adapter includes a first connector 196 adapted to be coupled to first connector 52 and a second connector 198 adapted to be coupled to second connector 56. A pneumatic circuit 200 is provided between first and second connectors 196 and 198. Pneumatic circuit 200 can be either a rigid piece or a flexible piece. In an exemplary embodiment, first connector 196 is shaped, sized, and configured to correspond to second connector 56, and second connector 198 is shaped, sized, and configured to correspond to first connector 52.

The present invention also contemplates that more than one adapter can be provided between connectors 52 and 56. In addition the adapter or adapters can have a variety of sizes shapes and configurations. For example, pneumatic circuit 200 can be a relatively long hose so that the portable liquid storage/delivery device need not be brought into close proximity to the liquefied gas storage system. The adapter can also have more than one second connector 198 so that the adapter can be used to fill more than one portable liquid storage/delivery device simultaneously. In addition, the adapter can include one or more valves to control the flow of liquefied gas through the adapter.

The adapter can also include a mounting plate or other member having a shape that generally matches that of interface 46. For example, the adapter can be a rigid piece that mounts onto a portable liquid storage/delivery device so that the fill port (e.g., connector 56) of the portable device is coupled to a connector (e.g., connector 198). The rigid piece can have a shape that allows it to fit into the pocket of interface 46. For example, the shape of the rigid piece can substantially correspond to the shape, size, and/or configuration of opening 48 or it can be smaller. This enables the adapter, or a portion of the adapter, to be placed into the pocket of the interface, so that it can connect to connector 52, effectively operating as the portable liquid storage/delivery device would if it were placed in the interface. The use of an adapter as a bridge between connectors 52 and 56, i.e., between the liquefied gas storage system and the portable liquid storage/delivery device, allows a portable liquid storage/delivery device having a body shape that does not match that of interface 46 to nevertheless be filled by the liquefied gas storage system.

The present invention also contemplates that turntable 44 be removably attached to housing 36. This enables one turntable to be swapped out or replaced by another even after the liquefied gas storage system has been provided to the user, i.e., while in the user's home. The present invention further contemplates that the interface of the second turntable can be different from that of the first turntable, e.g., have a different size, shape, depth, geometry, or configuration, so that a different portable liquid storage/delivery device suitable to interact with the interface of the second turntable, can be used with in the liquefied gas storage/delivery system. Of course, the second turntable should be configured such that connector 52 in liquefied gas storage system 32 is exposed for coupling to the portable liquid storage/delivery device.

By having the ability to attach different turntables, i.e., turntables with different interfaces 46, to liquefied gas storage system 32, the manufacture of the liquefied gas storage system can produce a liquefied gas storage system that can be used with a variety of different portable liquid storage/delivery devices depending on which turntable configuration is used with a given liquefied gas storage system. The selection of the appropriate turntable can be done after the rest of the liquefied gas storage system has been manufactured and assembled, and can take place in the manufacturing process or post manufacture as a feature change. This allows a manufacture to make a liquefied gas storage system that can be used with differently shaped portable liquid storage/delivery devices, depending on which turntable is assembled with the otherwise common components used in the liquefied gas storage system.

The interchangeable turntable feature of the present invention provides a great deal of flexibility on the field of liquid oxygen supply. For example, a medical device provider may keep a quantity of portable liquid storage/delivery devices having a first housing shape, a quantity of portable liquid storage/delivery devices having a second housing shape, a quantity of liquefied gas storage system of the present invention, a quantity of turntables having a first shaped interface, and a quantity of turntable having a second shaped interface. When the user is prescribed oxygen, the medical device provider may allow the user to select which portable liquid storage/delivery device he or she wants to use. Depending on this selection, the medical device provider will put the matching turntable on the liquefied gas storage system and provide that use with a liquefied gas storage system having a turntable suitable for use with the portable liquid storage/delivery device selected by the user.

Referring back to FIG. 1, the present invention contemplates providing the liquefied gas storage system with additional gas delivery and liquefied gas receiving capabilities. For example, the present invention contemplates that all or a portion of the gas produced by liquefaction system 40 can be provided to the user, as indicated by dashed line 210. A terminal 212 can be provided on the liquefied gas storage system that can be coupled to an oxygen delivery device, such as a nasal mask or cannula, so that a flow of oxygen-enriched gas can be provided to the user. The present invention contemplates that this flow of oxygen-enriched gas can be provided simultaneously with a flow of oxygen-enriched gas being provided to the liquefying portions of liquefaction system 40 or it can be provided instead of providing oxygen-enriched gas to the liquefying portions of the liquefaction system. This feature of the present invention allows as user to breathe oxygen-enriched gas from the liquefied gas storage system of the present invention.

In addition to breathing gas from liquefaction system 40, the present invention contemplates allowing a user to breathe oxygen-enriched gas from the gas and/or the liquefied gas that is contained in storage vessel 38, as indicated by dashed line 214. An evaporator 216 can be provided for converting the liquefied gas into a gas prior to deliver to the user. A terminal 218 is provided on liquefied gas storage system 32 that can be coupled to an oxygen delivery device. Although not shown, the present invention contemplated providing an oxygen conserving device, electronic or pneumatic, in the gas flow path from liquefied gas storage system 32 or from the oxygen generating portion of liquefaction system 40. This conserving device can be set via user interface 144 and operated under the control of processor 140 to deliver doses or pulses of oxygen to the user, for example, based on the user's breathing cycle.

It should be noted that the present invention contemplates that portable liquid storage/delivery device 34 can have an oxygen conserving device 220, electronic or pneumatic, as is know in the art. In addition, a connection terminal or barb 222 is provided on the portable liquid storage/delivery device so that an oxygen delivery interface, e.g., nasal mask or cannula, can be coupled to the portable liquid storage/delivery and a flow of gas can be provided to the patient.

The present invention further contemplates that the liquefied gas storage system need not produce its own liquefied gas. That is, liquefaction system 40 can be omitted entirely from the liquefied gas storage system. Instead, storage vessel 38 in liquefied gas storage system 32, 196 can be filled from a supply of liquefied gas as is known in the art with respect to existing stationary LOX storage devices. To enable filling of the liquefied gas storage system from a liquid gas supply, the present invention contemplates providing a fill port 230 so that the supply of liquefied gas can be coupled to the liquefied gas storage system. A pneumatic circuit 232 is provided between the fill port 230 and storage vessel 38.

Of course, the liquefied gas storage system can include both an internal liquefaction system and an external liquefied gas filling feature, as shown in FIG. 1. In addition, the present invention contemplates that a liquefaction system can be coupled to a liquefaction system, for example by connecting the output of a liquefaction system to the fill port 230. Liquefied gas storage system 32, 196 of the present invention can also include any other features typically found in existing stationary LOX storage devices.

Figure 13A:
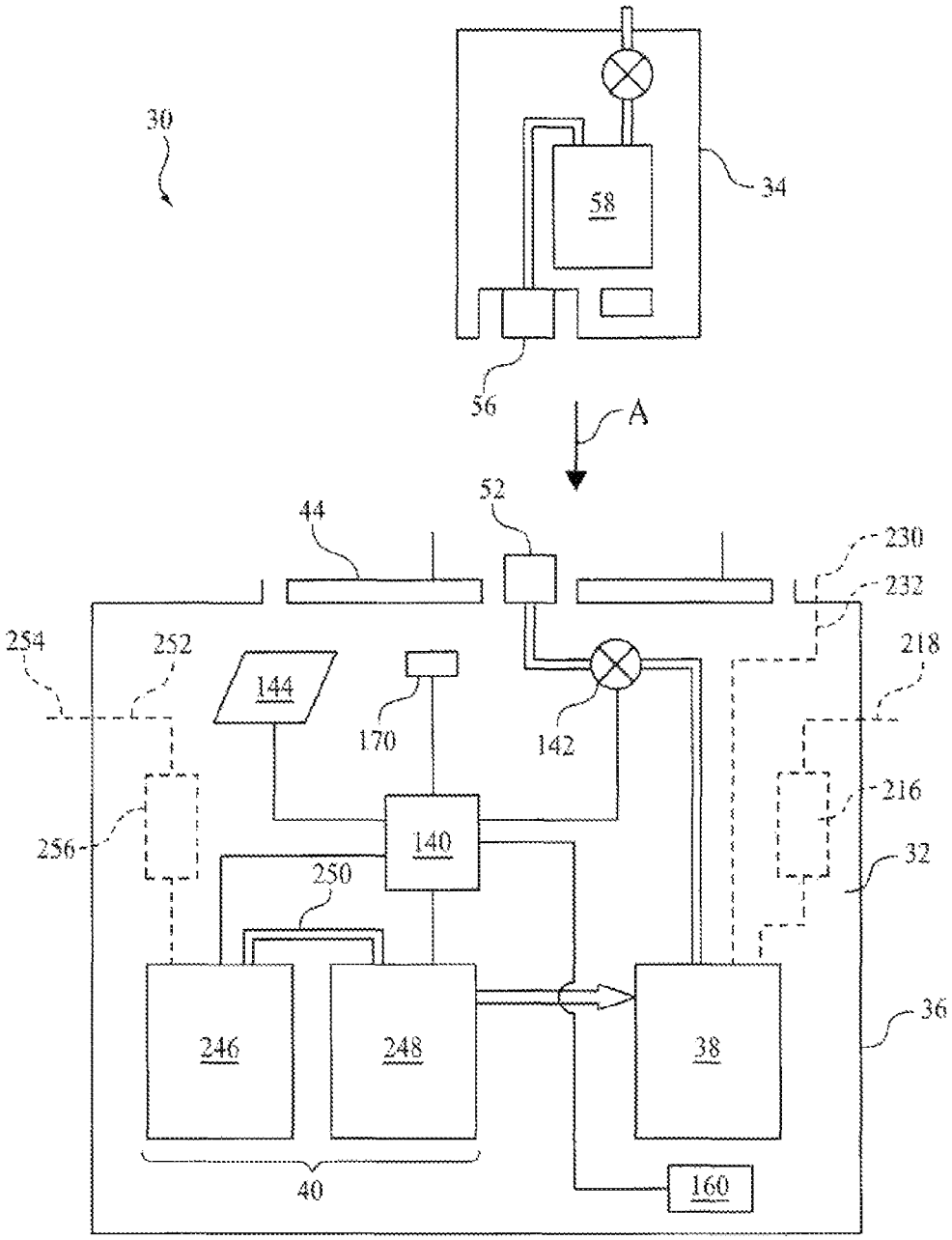
FIGS. 13A and 13B are a schematic diagrams of another embodiment of a liquefied gas storage/delivery system according to the principles of the present invention.

FIG. 13A schematically illustrates an embodiment of a liquefied gas storage/delivery system 30 that is generally similar to that shown in FIG. 1. Liquefied gas storage/delivery system 30 includes a liquefied gas storage system 32 and a portable liquid storage/delivery device 34. FIG. 13A shows explicitly that the present invention contemplates that liquefaction system 40 in liquefied gas storage system 32 includes both a gas generating system 246 and a liquefying system 248. Of course, as noted above, the present invention contemplates that the gas generating system can be omitted from within housing 36. In which case, gas to be liquefied is provided to the liquefier from a separate gas source, such as a wall connector, oxygen concentrator, etc.

As shown in FIG. 13A, liquefied gas storage/delivery system 30 includes gas generating system 246 that generates gas, such as oxygen, and liquefying system 248. Gas from generating system 246 is provided to liquefying system 248 via a gas line 250. The present invention contemplates providing any convention component or components between generating system 246 and liquefying system 248, such as pressure sensors, flow sensors, oxygen concentration sensor, desiccant dryers, pressure relief valves, shut off valves and the like in line 250.

In an exemplary embodiment, gas generating system 246 is a PSA system, such as that found in a conventional oxygen concentrator, and includes a gas compressor and one or more sieve beds. The present invention contemplates minimizing the size, weight, noise and/or power consumption of liquefied gas storage/delivery system 30, or at least the size, weight, noise, and/or power consumption of liquefied gas storage system 242, so that the system can be easily transported by a person. To assist in the transportation of the system, wheels, handles, and other mechanisms can be provided on housing 36.

In an exemplary embodiment, the gas compressor used in gas generating system 246 consumes less than 200 Watts, and the gas generating system produces 3 lpm of oxygen enriched gas. Of course, the present invention also contemplates other sizes (power consumption and oxygen output) for the compressor and gas generating system.

In a further exemplary embodiment liquefying system 248 uses a refrigerant compressor to cryocool the incoming gas flow for liquefaction. The present invention contemplates that the refrigerant compressor and the overall liquefying system be configured such that the liquefying system is capable of producing 1.5 kgs/day of liquid oxygen. This can be achieved using a refrigerant compressor that consumes less than 200 Watts, and, in particular 160-200 Watts. Thus the total power consumption of liquefied gas storage/delivery system is no greater than 400 Watts, while still producing 3 lpm of oxygen enriched gas and generating 1.5 kgs/day of liquid oxygen. The present invention further com If desired, all of the oxygen enriched gas produced by generating system 246 can be provided to a user via an oxygen line 252 and an output port 254. In which case, no oxygen enriched gas is provided to liquefying system 248. The present invention contemplates that components typically found in oxygen generating systems, such as filters, pressure sensors, oxygen concentration sensors, flow sensors, humidifier, oxygen conservers, buffer tank(s), and the like can be used in conjunction with generating system 246, oxygen line 250, and output port 252. These components are schematically illustrated as dashed box 256 in FIG. 13A.

The present invention also contemplates that a portion of the gas produced by gas generating system 246 can be provided to a user via an oxygen line 252 and a portion can be provided to liquefying system 248 via gas line 250. Thus, the liquid storage/delivery device of the present invention can simultaneously (a) deliver oxygen to the user and (b) fill storage vessel 38 with liquid oxygen.

Figure 13B:
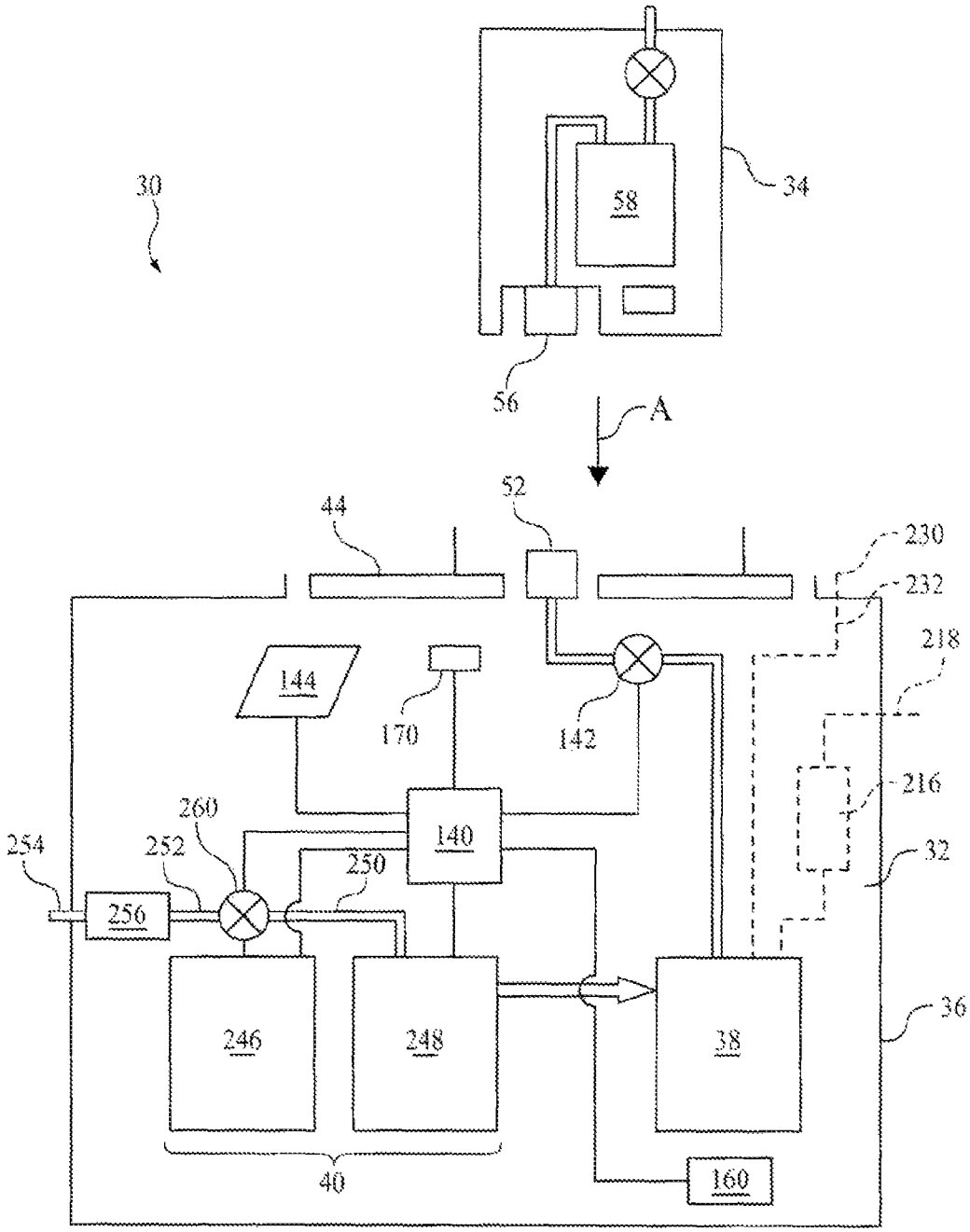

FIG. 13B illustrates a liquefied gas storage/delivery system 30 that is similar to that of FIG. 13B, except that liquefaction system 40 includes a valve 260 at the gas output of gas generating system 246. Valve 260 operates under the control of controller/processor 140 and controls the flow of oxygen enriched gas to the user via line 252 and to liquefying system 248 via gas line 250. In an exemplary embodiment, valve 260 is operated like an oxygen conserver, delivering boluses of gas to the user during a portion of the patient's respiratory cycle. When not delivering gas to the user, the gas is delivered to the liquefying system 248. Of course, the components necessary to sense the patient's breathing, such as flow sensors or pressure sensors would be needed.

Figure 14:
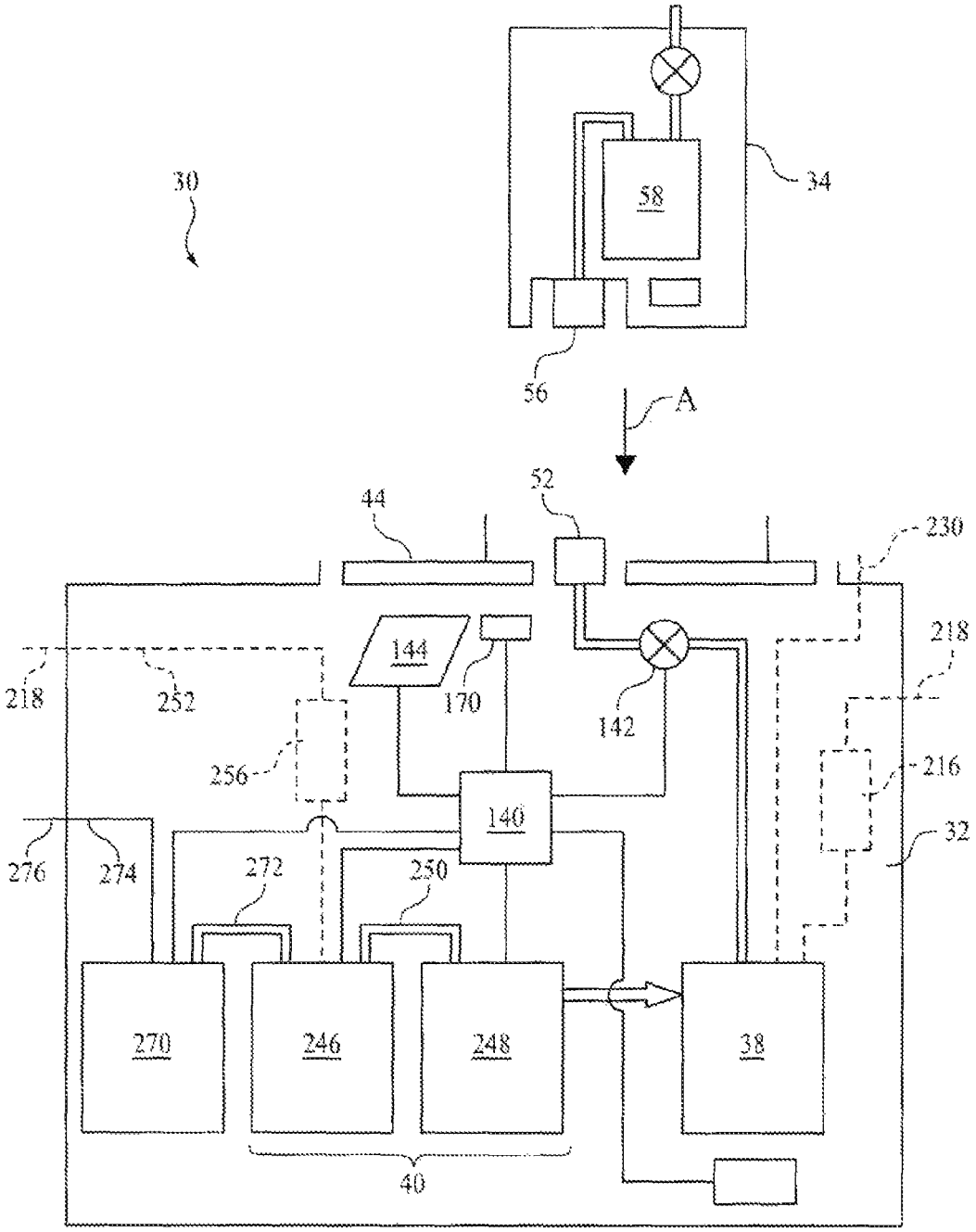
FIG. 14 is a schematic diagram of a still further embodiment of a liquefied gas storage/delivery system according to the principles of the present invention.

FIG. 14 schematically illustrates a liquefied gas storage/delivery system 30 that is generally similar to the previous embodiments. In this embodiment, liquefied gas storage system 32 includes a high pressure gas compressing system 270 that receives a flow of oxygen enriched gas from gas generating system 246 via gas line 272. High pressure gas compressing system 270 increases the pressure of the gas from gas generating system 246, which is typically 5-40 PSI to a pressure of 2200 or more PSI. The high pressure gas is suitable for filling a high pressure storage vessel (not shown) for subsequent consumption by the user. The present invention contemplates using any conventional high pressure gas compressing system 270. U.S. Pat. Nos. 5,354,361; 5,858,062; 5,988,165; 6,393,802; 6,446,630; 6,889,726; 6,904,913; and 6,923,180, the contents of each or which are incorporated herein by reference, all teach examples of high pressure gas compressing systems or components thereof that are suitable for use in the present invention.

The high pressure gas from high pressure gas compressing system 270 is provided to a storage vessel, such as a cylinder, via high pressure gas line 274 and outlet port 276. The present invention contemplates that outlet port 276 can be any conventional port that allows a high pressure gas storage vessel to receive the high pressure gas. Typically, this involve locking or otherwise attaching or clamping the high pressure storage vessel to output port 276.

Figure 15:
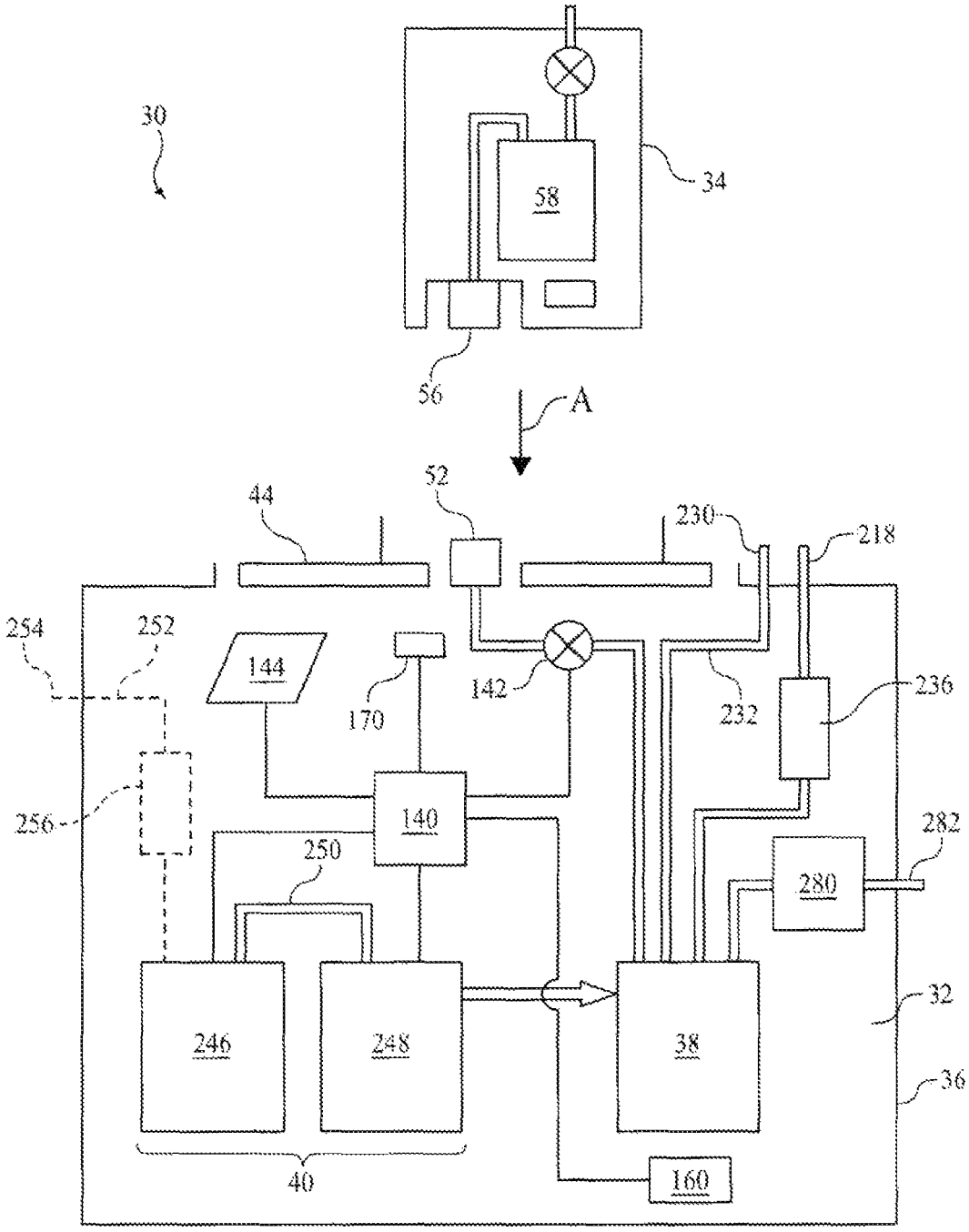
FIG. 15 is a schematic diagram of a yet another embodiment of a liquefied gas storage/delivery system according to the principles of the present invention.

FIG. 15. also schematically illustrates a liquefied gas storage/delivery system 30 that is generally similar to the previous embodiments. In this embodiment, liquefied gas storage system 32 includes a liquid to high pressure gas transfill system 280. Liquid to high pressure gas transfill system 280 converts a quantity of liquid oxygen into a high pressure gas for filling a portable storage vessel, such as a cylinder. An example of a liquid to high pressure gas transfill system suitable for use in the present invention is disclosed in U.S. provisional patent application No. 60/981,648, the contents of which are incorporated herein by reference.

In an exemplary embodiment, liquid to high pressure gas transfill system 280 includes a liquid oxygen evaporation device that includes an evaporation chamber. Liquid oxygen from storage vessel 38 is provided to the evaporation chamber. Once in the evaporation chamber, the liquid oxygen is permitted to boil or evaporate to create a quantity of gaseous oxygen. Boiling of the liquid oxygen can be accomplished or augmented by heating the liquid oxygen via a heater.

The quantity of gaseous oxygen is maintained in the vacant portion, or headspace, of the evaporation chamber. Significantly, the evaporation chamber is configured to maintain the gaseous oxygen at relatively high pressures. In an exemplary embodiment, the evaporation chamber is enabled to maintain gaseous oxygen at pressures ranging from 100 psig to 5,000 psig. For example, and without limitation, the evaporation chamber may consistently maintain gaseous oxygen around 2000 psig. In an alternative embodiment, the evaporation chamber is configured and arranged to maintain oxygen at pressures at or around 4000 psig.

An outlet port 282 is provided to provide the high pressure gas from liquid to high pressure gas transfill system 280 to a storage vessel. The present invention contemplates that outlet port 282 can be any conventional port that allows a high pressure gas storage vessel to receive the high pressure gas. Typically, this involve locking or otherwise attaching or clamping the high pressure storage vessel to output port 282.

The present invention contemplates that the various features of the different embodiments discussed above can be combined. For example, the liquid to high pressure gas transfill system of FIG. 15 can be included in the embodiment of FIGS. 1, 12, 13A, 13B, and 14. Also, the present invention contemplates providing power to the liquefied gas storage system using any conventional power source. For example, the power supply from the liquefied gas storage system can be external AC, external DC, such as a car charger or external batter, or an internal DC, such as one or more batteries contained in housing 36, or any combination thereof.

Although the invention has been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A method of providing ambulatory liquefied gas comprising:

providing a housing adapted to contain a supply of liquefied gas in a storage vessel;

coupling a portable liquid storage/delivery device to a turntable provided on an exterior surface of the housing, wherein the turntable is rotatable with respect to the housing between the first position and a second position;

moving the turntable to the first position to operatively disengage a first pneumatic connector included on the portable liquid storage/delivery device from a second pneumatic connector provided on the housing;

moving the turntable to the second position to physically engage the first pneumatic connector with the second pneumatic connector such that the storage vessel is placed in fluid communication, through the first pneumatic connector and the second pneumatic connector, with the portable liquid storage/delivery device; and transferring liquefied gas from the storage vessel, through the first pneumatic connector and the second pneumatic connector, to the portable liquid storage/delivery device responsive to the turntable being positioned in the second position.

2. The method of claim 1, wherein moving the turntable includes rotating the turntable between the first position in which the supply of liquified gas is prevented from being delivered from the storage vessel, and (b) the second position in which the supply of liquified gas is capable of being delivered from the storage vessel.

3. The method of claim 1, further comprising producing the liquefied gas using a liquefaction system disposed in the housing.

4. The method of claim 1, wherein transferring liquefied gas from the storage vessel to the portable liquid storage/delivery device includes increasing a pressure in the storage vessel.

5. The method of claim 1, further comprising receiving information associated with the portable liquid storage/delivery device responsive to the portable liquid storage/delivery device being coupled to the turntable.

6. The method of claim 1, further comprising providing a flow of gas across the first pneumatic connector.

* * * * *